US005809455A

United States Patent [19]

Nishiguchi et al.

[11] Patent Number: 5,809,455

[45] Date of Patent: Sep. 15, 1998

[54] METHOD AND DEVICE FOR DISCRIMINATING VOICED AND UNVOICED SOUNDS

[75] Inventors: Masayuki Nishiguchi, Kanagawa; Jun Matsumoto, Tokyo, both of Japan

[73] Assignee: Sony Corporation, Tokyo, Japan

[21] Appl. No.: 753,347

[22] Filed: Nov. 25, 1996

Related U.S. Application Data

[62] Division of Ser. No. 048,034, Apr. 14, 1993.

[30] Foreign Application Priority Data

Apr. 15, 1992 [JP] Japan ..... 4-121460
Jan. 6, 1993 [JP] Japan ..... 5-000828

[51] Int. Cl.[6] ..... G10L 3/02

[52] U.S. Cl. ..... 704/214; 704/213; 704/224; 704/211

[58] Field of Search ..... 395/2.14, 2.16, 395/2.19, 2.22, 2.23, 2.24, 2.33, 2.35

[56] References Cited

U.S. PATENT DOCUMENTS

| | | | |
|---|---|---|---|
| 4,158,751 | 6/1979 | Bode | 395/2.1 |
| 4,764,966 | 8/1988 | Einkauf et al. | 395/2.17 |
| 4,771,465 | 9/1988 | Bronson et al. | 395/2.17 |
| 4,817,155 | 3/1989 | Briar et al. | 395/2.17 |
| 5,007,093 | 4/1991 | Thomson | 704/214 |
| 5,046,100 | 9/1991 | Thomson | 704/214 |
| 5,216,747 | 6/1993 | Hardwick et al. | 395/2.09 |
| 5,473,727 | 12/1995 | Nishiguchi et al. | 395/2.31 |
| 5,630,012 | 5/1997 | Nishiguchi et al. | 395/2.17 |

OTHER PUBLICATIONS

"New Feature Extarction Mehods and the Concept of Time–Warped Distance in Speech Processing", 1991, Gordos.

"Single Channel Adaptive Noise Cancelation for Enhancing Noisy Speech", 1994 International Symposium on Speech, Image Processing, and Neural Networks, Apr. 1994.

"Harmonic and noise coding of LPC residuals with classified vector quantization", Nishiguchi et al, May 1995.

"Vector Quantized MBE with Simplified V/UV Division at 3.0 KPBS", Nishiguchi et al, 1993.

*Primary Examiner*—David R. Hudspeth
*Assistant Examiner*—Michael N. Opsasnick
*Attorney, Agent, or Firm*—Pasquale Musacchio; Jerry A. Miller

[57] ABSTRACT

A method and a device for discriminating a voiced sound from an unvoiced sound or background noise in speech signals are disclosed. Each block or frame of input speech signals is divided into plural sub-blocks and the standard deviation, effective value or the peak value is detected in a detection unit for detecting statistical characteristics from one sub-block to another. A bias detection unit detects a bias on the time scale of the standard deviation, effective value or the peak value to decide whether the speech signals are voiced or unvoiced from one block to another.

17 Claims, 13 Drawing Sheets

METHOD AND DEVICE FOR DISCRIMINATING VOICED AND UNVOICED SOUNDS

This application is a division of application Ser. No. 08/048,034, filed Apr. 14, 1993, pending, which is hereby incorporated by reference.

BACKGROUND OF THE INVENTION

1. Field of the Invention

This invention relates to a method and a device for making discrimination between the voiced sound and the noise or the unvoiced sound in speech signals.

2. Statement of Related Art

The speech or voice is classified into the voiced sound and the unvoiced sound. The voiced sound is the voice accompanied by vibrations of the vocal cord and consists in periodic vibrations. The unvoiced sound is the voice not accompanied by vibrations of the vocal cord and consists in non-periodic vibrations. The usual speech is composed mainly of the voiced sound, with the unvoiced sound being a special consonant termed unvoiced consonant. The period of the voiced sound is determined by the period of the vibrations of the vocal cord and is termed the pitch period, a reciprocal of which is termed a pitch frequency. In the following description, the term pitch means a pitch period. The pitch period and the pitch frequency are crucial factors on which depend highness or lowness of the speech or the intonation. Thus the sound quality of the speech depends on how precisely the pitch is grasped. However, in grasping the pitch, it is necessary to take account of the noise around the speech, or so-called background noise as well as quantization noise produced on quantization of analog signals into digital signals. In encoding speech signals, it is crucial to make distinction between the voiced sound from these noises and the unvoiced sound.

Among analog speech analysis systems, hitherto known in the art, there are such systems as disclosed in U.S. Pat. Nos. 4,637,046 and 4,625,327. In the former, input analog speech signals are divided into segments in the chronological sequence,and signals contained in these segments are rectified to find a maximum value which is compared to a threshold value to make a voice/unvoiced decision. In the latter, analog speech signals are converted into digital signals and divided into segment and discrete Fourier transform is carried out from segment to segment to find an absolute value for each spectrum which is then compared to a threshold value to make a voiced/unvoiced decision.

Specific examples of encoding of speech signals include multi-band excitation coding (MBE), single band excitation coding (SBE), harmonic coding, sub-band coding (SBC), linear predictive coding (LPC), discrete cosine transform (DCT), modified DCT (MDCT) and fast Fourier transform (FFT).

For extracting the pitch from the input speech signal waveform by MBE coding, for example, pitch extraction may be achieved easily even if the pitch is not represented manifestly. For decoding at the synthesis side, a voiced sound waveform on the time domain is synthesized based on the pitch so as to be added to a separately synthesized unvoiced sound waveform on the time domain.

Meanwhile, if the pitch is adapted to be extracted easily, it may occur that a pitch that is not a true pitch be extracted in background noise segments. If such pitch other than the true pitch be extracted by MBE encoding, cosine waveform synthesis is performed so that peak points of the cosine waves are overlapped with one another at a pitch which is not the true pitch. That is, the cosine waves are synthesized by addition at a fixed phase (0-phase or $\pi/2$ phase) in such a manner that the voiced sound is synthesized at a pitch period which is not the true pitch period, such that the background noise devoid of the pitch is synthesized as a periodic impulse wave. In other words, amplitude intensities of the background noise, which intrinsically should be scattered on the time axis, are concentrated in a frame portion,with certain periodicity to produce an extremely obtrusive extraneous sound.

SUMMARY OF THE INVENTION

In view of the above-depicted status of the art, it is an object of the present invention to provide a method for making discrimination between voiced and unvoiced sounds whereby the voiced sound may positively be distinguished from the noise or unvoiced sound for preventing obtrusive extraneous sound from being produced during speech synthesis.

In one aspect, the present invention provides a method for discriminating a voiced sound from unvoiced sound or noise in input speech signals by dividing the input speech signals into blocks and giving a decision for each of these blocks as to whether or not the speech signals are voiced comprising the steps of subdividing one-block signals into a plurality of sub-blocks, finding statistical characteristics of the signals from one sub-block to another, and deciding whether or not the speech signals are voiced depending on a bias of the statistical characteristics on the time scale.

The peak value, effective value or the standard deviation of the signals for each of the sub-blocks may be employed as the aforementioned statistical characteristics.

In another aspect, the present invention provides a method for discriminating a voiced sound from an unvoiced sound or noise in input speech signals by dividing the input speech signals into blocks and giving a decision for each of these blocks as to whether or not the speech signals are voiced comprising the steps of finding the energy distribution of one-block signals on the frequency scale, finding the signal level of said one-block signals, and deciding whether or not the speech signals are voiced depending on the energy distribution and the signal level of one-block signals on the frequency scale.

Such voiced/unvoiced decision may also be made depending on the statistical characteristics of sub-block signals, namely the effective value, the standard deviation or the peak value and energy distribution of one block signals on the frequency scale, or alternatively, on the statistical characteristics of the sub-block signals, namely the effective value, the standard deviation or the peak value and the signal level of one-block signals.

In still another aspect, the present invention provides a method for discriminating a voiced sound from unvoiced sound or noise in input speech signals by dividing the input speech signals into blocks and giving a decision for each of these blocks as to whether or not the speech signals are voiced comprising the steps of subdividing one-block signals into a plurality of sub-blocks, finding statistical characteristics of the signals, that is effective value, standard deviation or peak value, from one sub-block to another, finding the energy distribution of the one-block signals on the frequency scale, finding the signal level of the one-block signals on the frequency scale, and deciding whether or not the speech signals are voiced depending on the effective value, standard deviation or the peak value, the energy distribution of the one-block signals on the frequency scale, and the signal level of the one-block signals on the frequency scale.

In yet another aspect, the present invention provides a method for discriminating a voiced sound from unvoiced sound or noise in input speech signals by dividing the input speech signals into blocks and giving a decision for each of these blocks as to whether or not the speech signals are voiced comprising the steps of subdividing one-block signals into a plurality of sub-blocks, finding an effective value on the time scale for each of the sub-blocks and finding the distribution of the effective values for each of the sub-blocks based on the standard deviation and mean value of these effective values, finding energy distribution of said one-block signals on the frequency scale, finding the level of said one-block signals and deciding whether or not the speech signals are voiced depending on at least two of the distribution of the effective value from sub-block to sub-block, energy distribution of the one-block signals on the frequency scale and the level of the one-block signals.

The decision as to whether or not the speech signals are voiced means discriminating the voiced sound from the unvoiced sound or noise in the speech signals.

The voiced sound in the speech signals may be discriminated from the unvoiced signal or the noise by relying when the difference in the bias in the statistical characteristics on the time scale between the voiced signals and the unvoiced signals or the noise.

DETAILED DESCRIPTION OF THE PREFERRED EMBODIMENTS

Figure 1A:
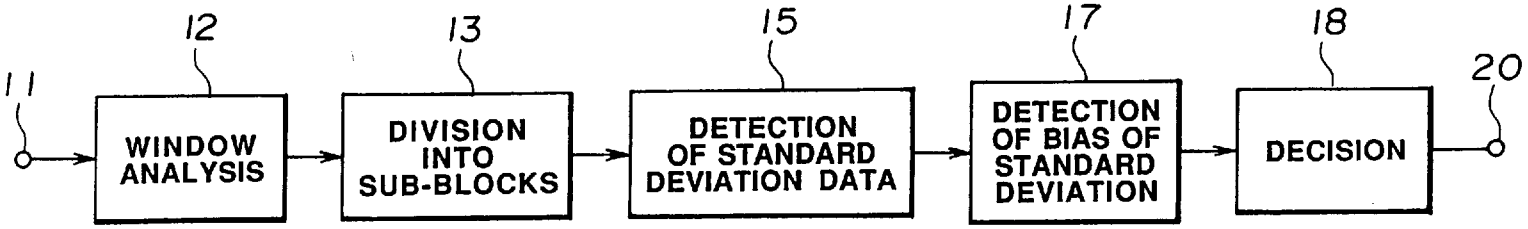
FIGS. 1*a* to 1*c* are functional block diagrams showing a schematic arrangement of a voiced sound discriminating device for illustrating a first embodiment of the voiced sound discriminating device according to the present invention.

Referring to the drawings, preferred embodiments of the method for making discrimination between voiced and unvoiced sounds according to the present invention will be explained in detail.

Figure 1B:
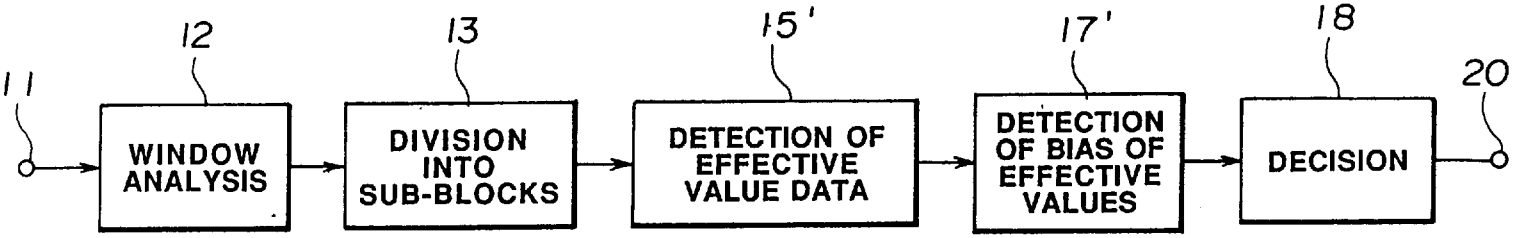
Figure 1C:
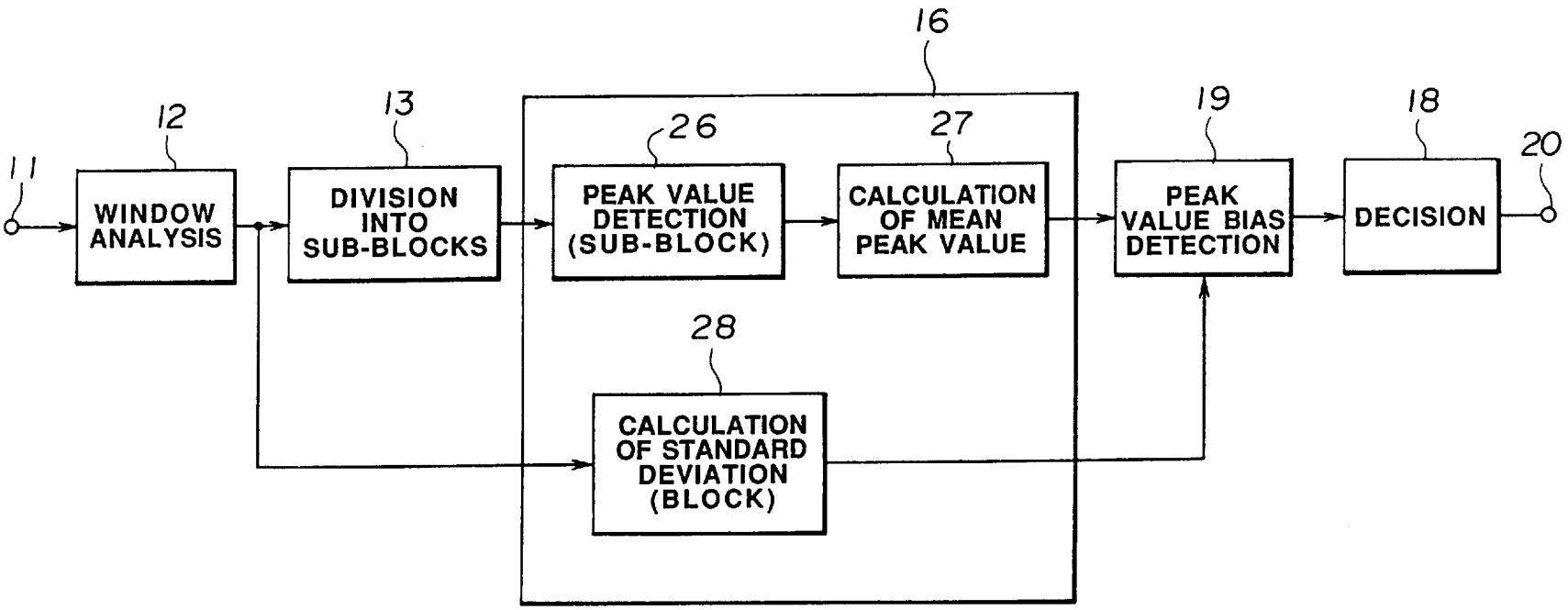

FIGS. 1*a* to 1*c* show a schematic arrangement of a device for making discrimination between voiced and unvoiced sounds for illustrating the voiced sound discriminating method according to a first embodiment of the present invention. The present first embodiment is a device for making discrimination of whether or not the speech signal is voiced a sound depending on the bias on the time domain of statistical characteristics of speech signals for each of sub-blocks of speech signals divided from a block of speech signals.

Referring to FIGS. 1*a* and 1*b*, digital speech signals, freed of at least low-range signals (with frequencies not higher than 200 Hz) for elimination of a dc offset or bandwidth limitation to e.g. 200 to 3400 Hz by a high-pass filter (HPF), not shown; are supplied to an input terminal 11. These signals are transmitted to a windowing or window analysis unit 12. In the analysis unit 12, each block of the input digital signals consisting of N samples, N being 256, is windowed with a rectangular window, so that the input signals are sequentially time-shifted an interval of a frame consisting of L samples, where L equals 160. An overlap between adjacent blocks is (N−L) samples or 96 samples. This technique is disclosed in e.g. IEEE Transaction on Acoustics Speech and Signal Processing, vol.ASSP-28, No. 1, February 1980, pp. 90 to 101. Signals of each block, consisting of N samples, from the window analysis unit 12, are supplied to a sub-block division unit 13. The sub-block division unit 13 sub-divides the signals of each block from the window analysis unit 12 into sub-blocks. The resulting sub-block signals are supplied to a detection unit for detecting statistical characteristics. In the present first embodiment, the detection unit is a standard deviation data detection unit 15 shown in FIG. 1*a*, an effective value data detection unit 15' shown in FIG. 1*b* or a peak value detection unit 16 in FIG. 1*c*. The standard deviation data from the standard deviation data detection unit 15 are supplied to a standard deviation bias detection unit 17. The effective value data from the effective value data detection unit 15' are supplied to an effective value bias detection unit 17'. The detection units 17, 17' detect the bias of the standard deviation and the effective values of each sub-block from the standard value data and from the effective value data, respectively. The time-base data concerning the bias of the standard deviation or effective values are supplied to a decision unit 18. The decision unit 18 compares the time-base data concerning the bias of the standard deviation values or the effective values to a predetermined threshold for deciding whether or not the signals of each sub-block are voiced and outputs resulting decision data at an output terminal 20. Referring to FIG. 1*c*, peak value data from peak value data detection unit 16 are supplied to a peak value bias detection unit 19. The unit 19 detects the bias of peak values of the time domain signals from the peak value data. The resulting data concerning the bias of peak values of the time domain signals are supplied to decision unit 18. The unit 18 compares the time-base data concerning the bias of the peak values of the signals on the time domain to a predetermined threshold for deciding whether or not the signals of each sub-block are voiced and outputs resulting decision data at an output terminal 20. The detection of the effective values, standard deviation values and the peak values of the sub-block signals, employed in the present embodiment as statistical characteristics, as well as the detection of the bias of these values on the time domain, is hereinafter explained.

Figure 2A:
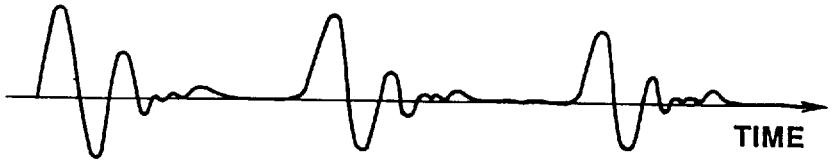
FIGS. 2*a* to 2*d* are waveform diagrams for illustrating statistical characteristics of signals.
Figure 2B:
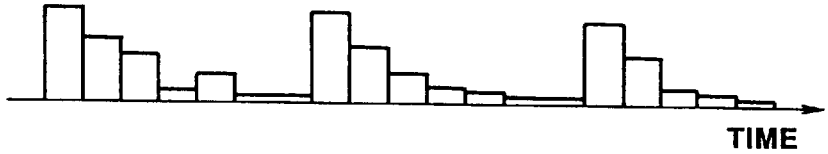
Figure 2C:
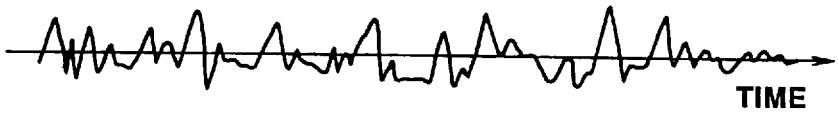
Figure 2D:
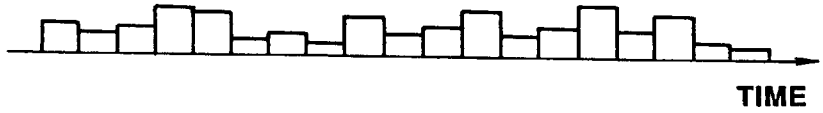

The reason the standard deviation, effective values or the peak values of the sub-block signals are found in the present first embodiment is that the standard deviation, effective values or the peak values differ significantly on the time domain between the voiced sound and the noise or the unvoiced sound. For example, the vowel (voiced sound) of speech signals shown in FIG. 2*a* is compared to the noise or the consonant (unvoiced sound) thereof shown in FIG. 2*c*. The peak amplitude values of the vowel sound are arrayed in an orderly fashion, while exhibiting a bias on the time domain, as shown in FIG. 2*b*, whereas those of the consonant sound or unvoiced sound are arrayed in a disorderly fashion, although they exhibit certain flatness or uniformity on the time domain, as shown in FIG. 2*d*.

The detection units 15, 15', shown in FIGS. 1*a* and 1*b*, for detecting the standard value data and the effective value data, respectively, from one sub-block to another, and detection of the bias of the standard deviation data or the effective value data on the time domain, are hereinafter explained.

Figure 3A:
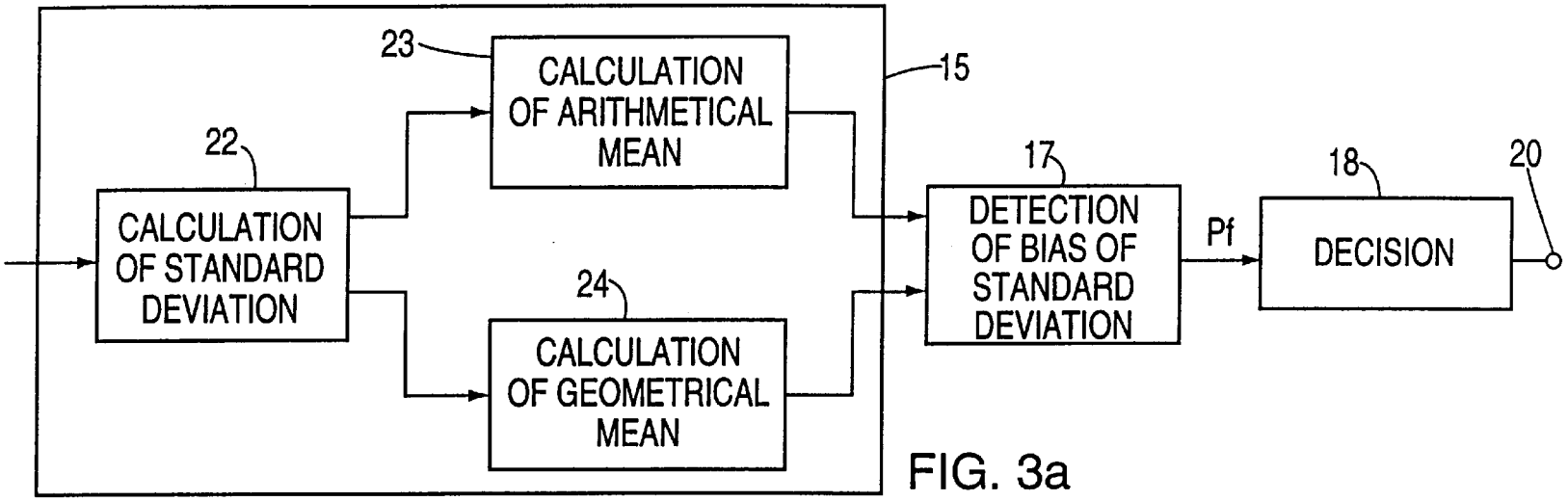
FIGS. 3*a* and 3*b* are functional block diagrams for illustrating an arrangement of essential portions of a voiced/unvoiced discriminating device for illustrating the first embodiment.
Figure 3B:
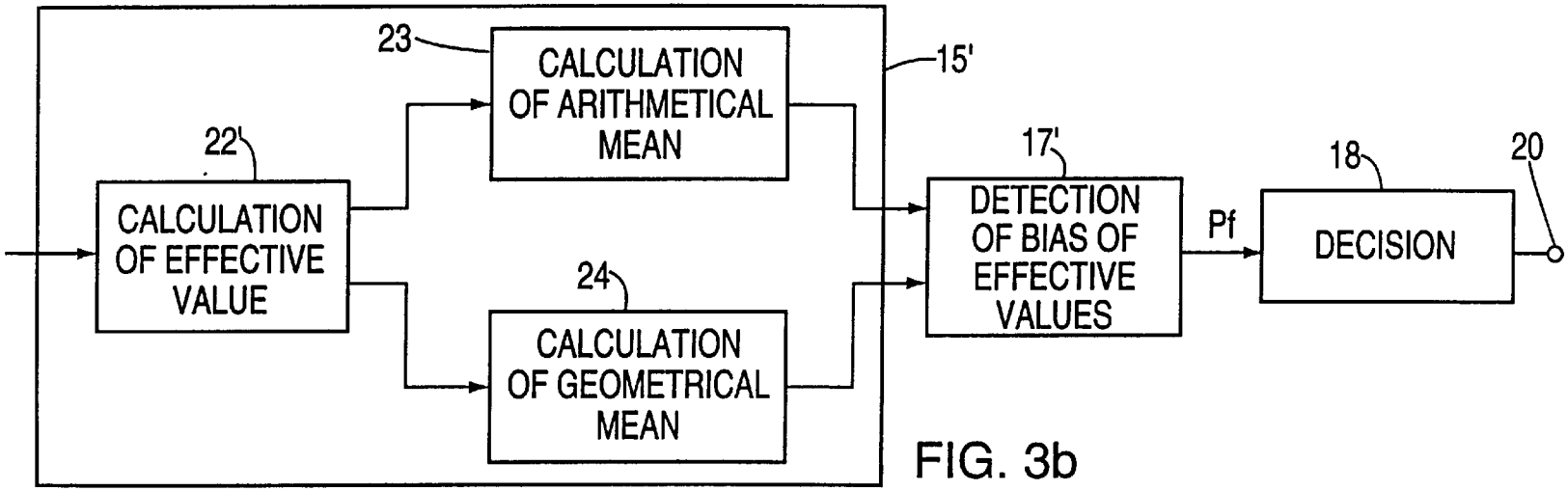

The detection unit 15 for detecting standard deviation values, shown in FIG. 3*a*, is made up of a standard deviation calculating unit 22 for calculating the standard deviation of the input sub-block signals, an arithmetical mean calculating unit 23 for calculating an arithmetical mean of the standard deviation values, and a geometrical mean calculating unit 24 for calculating a geometrical mean of the standard deviation values. Similarly, the detection unit 15' for detecting effective values, shown in FIG. 3*b*, is made up of an effective value calculating unit 22' for calculating the effective values for input sub-block signals, an arithmetical mean calculating unit 23' for calculating an arithmetical mean of the effective values, and a geometrical mean calculating unit 24 for calculating a geometrical mean of the effective values. The detection units 17, 17' detect bias data on the time domain from the arithmetical and the geometrical mean values, while the decision unit 18 decides, from the bias data, whether or not the sub-block speech signals are voiced, and the resulting decision data is outputted at output terminal 20.

By referring to FIGS. 1*a* and 1*b* and FIGS. 3*a* and 3*b*, the principle of deciding whether or not the speech signals are voiced sound based on the above-mentioned energy distribution is explained.

The number of samples N of a block as segmented by windowing with a rectangular window by the window analysis unit 12 is assumed to be 256, and a train of input samples is indicated as x(n). The 256-sample block is divided by the sample block division unit 13 at an interval of 8 samples. Thus an $N/B_L$ (=256/8=32) number of sub-blocks, each having a sub-block length $B_L$=8, are present in one block. These 32 sub-block time-domain data are supplied to e.g. the standard deviation calculating unit 22 of the standard deviation data detection unit 15 or of the effective value detection unit 15' of the effective data calculating unit 15'.

The calculating units 22, 22' output standard deviation value $\sigma_a(i)$ of the time-domain data, as found by the formula $$\sigma_n(i) = \sqrt{\frac{1}{B_1} \sum_{n=k}^{k+B_1-1} (x(n) - \underline{x})^2} \tag{1}$$

at $0 \leqq i < N/B_1$
where $k = i \times B_1$
at $0 \leqq i < N/B_1$ from one sub-block to another. In the above formula, i is an index for a sub-block and k is a number of samples, while $\underline{x}$ is a mean value of the input samples for each block. It should be noted that the mean value $\underline{x}$ is not a mean value for each sub-block but is a mean value for each block, that is a mean value of the N number of samples of each block.

Also it should be noted that the effective value for each sub-block is also given by the formula (1) in which $(x(n))^2$, that is a root-mean-square (rms) value, is substituted for the term $(x(n)-X)^2$.

The standard deviation $\sigma_a(i)$ is supplied to arithmetical mean calculating unit 23 and to geometrical mean calculating unit 24 for checking into signal distribution on the time axis. The calculating units 23,24 calculate the arithmetical mean $a_{v:add}$ and the geometrical mean $a_{v:mpy}$ in accordance with formulas (2) and (3):

$$a_{v:add} = \frac{1}{N/B_1} \sum_{i=0}^{N/B_1-1} \sigma_n(i) \tag{2}$$

$$a_{v:mpy} = \left\{ \prod_{i=0}^{N/B_1-1} \sigma_a(i) \right\}^{1/N/B_1} \tag{3}$$

It is noted that, while the formulas (1) to (3) are concerned only with the standard deviation, similar calculation may be made for the effective values as well.

The arithmetical mean $a_{v:add}$ and the geometrical mean $a_{v:mpy}$, as calculated in accordance with the formulas (1) to (3), are supplied to the standard deviation bias detection unit 17 or to the effective value bias detection unit 17'. The standard deviation bias detection unit 17 or the effective value bias detection unit 17' calculate a ratio $p_f$ from the arithmetical mean $a_{v:add}$ and the geometrical mean $a_{v:mpy}$ with formula (4).

$$p_f = a_{v:add} / a_{v:mpy} \tag{4}$$

The ratio $p_f$, which is a bias data representing the bias of the standard deviation data on the time scale, is supplied to decision unit 18. The decision unit 18 compares the bias data (ratio $p_f$) to a predetermined threshold $p_{thf}$ to decide whether or not the sound is voiced. For example, if the threshold value $p_{thf}$ is set to 1.1, and the bias data $p_f$ is found to be larger than it, a decision is given that a deviation from the standard deviation or the effective value is larger and hence the signal is a voiced sound. Conversely, if the distribution data $p_f$ is smaller than the threshold value $p_{thf}$, a decision is given that deviation from the standard deviation or the effective value is smaller, that is the signal is flat, and hence the signal is unvoiced, that is noise or unvoiced sound.

Referring to FIG. 1*c*, the peak value data detection unit 16 for detecting peak value data and detection of bias of the peak values on the time scale, are hereinafter explained. The peak value detection unit 16 is made up of a peak value detection unit 26 for detecting a peak value from sub-block signals from one sub-block to another, a mean peak value calculating unit 27 for calculating a mean value of the peak values from the peak value detection unit 26, and a standard deviation calculating unit 28 for calculating a standard deviation from the block-by-block signals supplied from the window analysis unit 12. The peak value bias detecting unit 19 divides the mean peak value from the mean peak value calculating unit 27 by the block-by-block standard deviation value from the standard deviation calculating unit 28 to find bias of the mean peak values on the time axis. The mean peak value bias data is supplied to decision unit 18. The decision unit 18 decides, based on the mean peak value bias data, whether or not the sub-block speech signal is voiced, and outputs a corresponding decision signal at output terminal 20.

The principle of deciding from the peak value data whether or not the signal is voiced is explained by referring to FIG. 1*c*.

An $N/B_L$ number of sub-block signals, that is 256/8=32 sub-block signals, having a sub-block length $B_L$=8, for example, are supplied to the peak value detection unit 26 via window analysis unit 12 and sub-block division unit 13. The peak value detection unit 26 detects a peak value P(i) for each of the 32 sub-blocks in accordance with the formula (5)

$$P(i) = \max_{k \leq n \leq k+B_1-1} (|x(n)|) \tag{5}$$

at $0<i<N/B_1$ where $k=i \times B_1$

In formula (5), i is an index for sub-blocks and k is the number of samples while MAX is a function for finding a maximum values.

The mean peak value calculating unit 27 calculates a mean peak value $\underline{P}$ from the above peak value P(i) in accordance with the formula (6).

$$\underline{P} = \frac{1}{N/B_1} \sum_{i=0}^{N/B_1-1} P(i) \tag{6}$$

The standard deviation calculating unit 28 finds the block-by-block standard deviation $\sigma_b$ in accordance with the formula (7)

$$\sigma_b = \sqrt{\frac{1}{N} \sum_{n=0}^{N-1} (x(n) - \underline{x})^2} \tag{7}$$

The peak value bias detection unit 19 calculates the peak value bias data $P_n$ from the mean peak value $\underline{P}$ and the standard deviation $\sigma_b$ in accordance with the formula (8)

$$P_n = \underline{P}/\sigma_b \tag{8}$$

It is noted that an effective value calculating unit for calculating an effective value (rms value) may also be employed in place of the standard deviation calculating unit 28.

The peak value bias data $P_n$, as calculated in accordance with formula (8), is a measure for bias(localized presence) of the peak values on the time scale, and is transmitted to decision unit 18. The decision unit 18 compares the peak value bias data $P_n$ to the threshold value $P_{thn}$ to decide whether or not the signal is a voiced sound. For example, if the peak value bias data $P_n$ is smaller than the threshold value $P_{thn}$, a decision is given that the bias of the peak values on the time axis is larger and hence the signal is a voiced sound. On the other hand, if the peak value bias data $P_n$ is larger than the threshold value $P_{thn}$, a decision is given that deviation of the bias of the peak values on the time scale is smaller and hence the signal is a noise or an unvoiced sound.

With the above-described first embodiment of the voiced sound discrimination method according to the present invention, the decision as to whether the sound signal is voiced is given on the basis of the bias on the time scale of certain statistic characteristics, such as peak values, effective values or standard deviation, of the sub-block signals.

Figure 4:
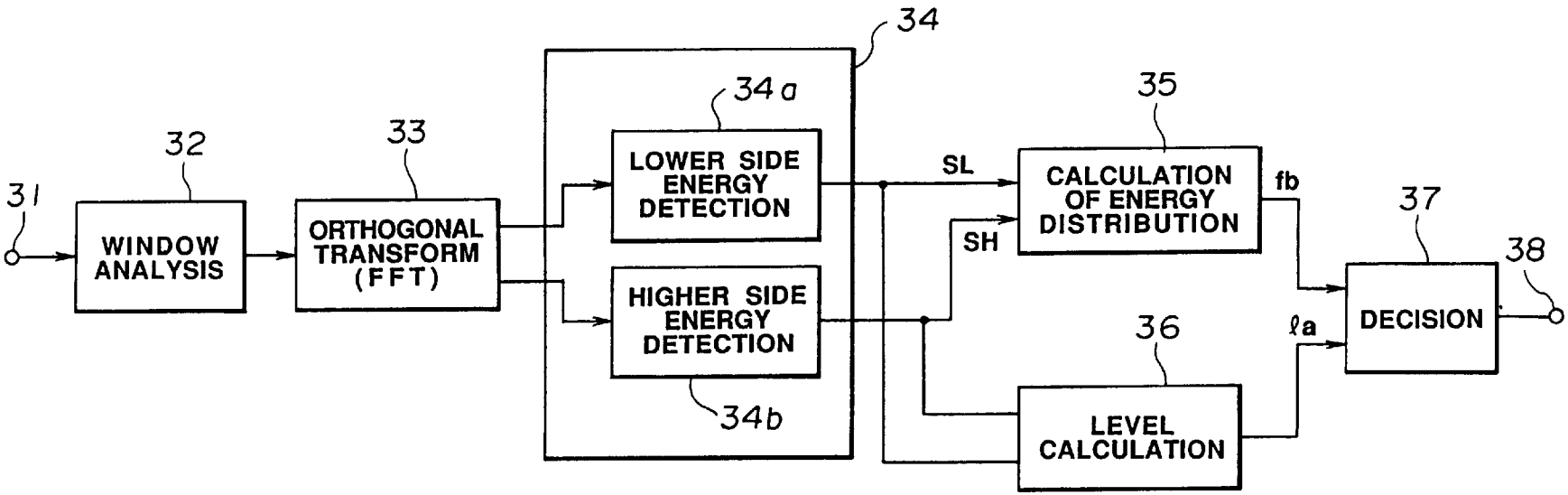
FIG. 4 is a functional block diagram showing a schematic arrangement of a voiced sound discriminating device for illustrating a second embodiment of the voiced sound discriminating device according to the present invention.

A voiced sound discriminating device for illustrating the voiced sound discriminating method according to the second embodiment of the present invention is shown schematically in FIG. 4. With the present second embodiment, a decision as to whether or not the sound signal is voiced is made on the basis of the signal level and energy distribution on the frequency scale of the block speech signals.

With the present second embodiment, the tendency for the energy distribution of the voiced sound to be concentrated towards the low frequency side on the frequency scale and for the energies of the noise or the unvoiced sound to be concentrated towards the high frequency side on the frequency scale, is utilized.

Referring to FIG. 4, digital speech signals, freed of at least low-range signals (with frequencies not higher than 200 Hz) for elimination of a dc offset or bandwidth limitation to e.g. 200 to 3400 Hz by a high-pas filter (HPF), not shown, are supplied to an input terminal 31. These signals are transmitted to a window analysis unit 32. In the analysis unit 32, each block of the input digital signals consisting of N samples, N being 256, are windowed with a hamming window, so that the input signals are sequentially time-shifted at an interval of a frame consisting of L samples, where L equals 160. An overlap between adjacent blocks is (N−L) samples or 96 samples. The resulting N-sample block signals, produced by the window analysis unit 32, are transmitted to an orthogonal transform unit 33. The orthogonal transform unit 33 orthogonally transforms a sample string, consisting of 256 samples per block, such as by fast Fourier transform (FFT), for converting the sample string data into a data string on the frequency scale. The frequency-domain data from the orthogonal transform unit 33 are supplied to an energy detection unit 34. The energy detection unit 34 divides the frequency domain data supplied thereto into low-frequency data and high-frequency data, the energies of which are detected by a low-frequency energy detection unit 34*a* and a high-frequency energy detection unit 34*b*, respectively. The low-range energy values and high- range energy values, as detected by low-frequency energy detection unit 34*a* and high-frequency energy detection unit 34*b*, respectively, are supplied to an energy distribution calculating unit 35, where the ratio of the two detected energy values is calculated as energy distribution data. The energy distribution data, as found by the energy distribution calculating unit 35, is supplied to a decision unit 37. The detected values of the low-range and high-range energies are supplied to a signal level calculating unit 36 where the signal level per sample is found. The signal level data, as calculated by the signal level calculating unit 36, is supplied to decision unit 37. The unit 37 decides, based on the energy distribution data and the signal level data, whether the input speech signal is voiced, and outputs a corresponding decision data at an output terminal 38.

The operation of the above-described second embodiment is hereinafter explained.

The number of samples N of a block as segmented by windowing with a hamming window by the window analysis unit 12 is assumed to be 256, and a train of input samples is indicated x(n). The time-domain data, consisting of 256 samples per block, are converted by the orthogonal transform unit 33 into one-block frequency-domain data. These one-block frequency-domain data are supplied to the energy detection unit 34 where an amplitude $a_m(j)$ is found in accordance with the formula (9)

$$a_m(j) = \sqrt{R_e^2 + I_m^2(j)} \tag{9}$$

where $R_e(j)$ and I(j) indicate a real number part and an imaginary number part, respectively, and i indicates a number of samples of not less than 0 and less than N/2 (=128 samples).

The low-energy detection unit 34*a* and 34*b* high energy detection unit of the energy detection unit 34 find the low-range energy $S_L$ and the high-range energy $S_H$, respectively, from the amplitude $a_m(j)$ in accordance with the formulas (10) and (11)

$$S_L = \sum_{j=0}^{N/4-1} a_m^2(j) \tag{10}$$

$$S_H = \sum_{j=N/4}^{N/2-1} a_m^2(j) \tag{11}$$

The low range is herein a frequency range of e.g. 0 to 2 kHz, while the high range is a frequency range of 2 to 3.4 kHz. The low-range energies $S_L$ and the high-range energies $S_H$, as calculated by the formulas (10), (11), respectively, are supplied to distribution calculating unit 35 where energy distribution balance data, that is energy distribution data on the frequency axis $f_b$, is found based on the ratio $S_L/S_H$. That is, $$f_b = S_L/S_H \tag{12}$$

The energy distribution data $f_b$ on the frequency scale is supplied to decision unit 37 where the energy distribution data $f_b$ is compared to a predetermined value $f_{thb}$ to make decision as to whether or not the speech signal is voiced. If, for example, the threshold $f_{thb}$ is set to 15, and the energy distribution data $f_b$ is smaller than $f_{thb}$, a decision is given that the speech signal is likely to be a noise or unvoiced sound, instead of a voiced sound, because of concentrated energy distribution in the high frequency side.

On the other hand, the low-range energies $S_L$ and the high-range energies $S_H$ are also supplied to signal level calculation unit 36 where data on a signal mean level $l^a$ is found in accordance with the formula $$l_a = \sqrt{\frac{S_L + S_H}{N/2}} \tag{13}$$

using the low-range energies $S_L$ and the high-range energies $S_H$. The mean level data $l^a$ is also supplied to decision unit 37. The decision unit 37 compares the mean level data $l_a$ to a predetermined threshold $l_{tha}$ to decide whether or not the speech sound is voiced. If, for example, the threshold value $l_{tha}$ is set to 550, and the mean level data $l^a$ is smaller than the threshold value $l_{tha}$, a decision is given that the signal is not likely to be voiced sound, that is, it is likely to be a noise or unvoiced sound.

It is possible with the decision unit 37 to give the voiced/unvoiced decision based on one of the energy distribution data $f_b$ or the mean level data $l_a$, as described above. However, if both of these data are used, the decision given has improved reliability. That is, with $f_b < f_{thb}$ and $l_a < l_{tha}$, the speech is decided to be voiced with higher reliability. The decision data is issued at output terminal 38.

Besides, the energy distribution data $f_b$ and the mean level data l*a* according to the present second embodiment may be separately combined with the ratio $p_f$ which is the bias data of the standard deviation values or effective values on the time scale according to the first embodiment to give a decision as to whether or not the speech signal is voiced. That is, if $p_f < p_{thf}$ and $f_b < f_{thb}$, or $p_f < p_{thf}$ and $l_a < f_{tha}$, the signal is decided to be not voiced with higher reliability.

In this manner it is possible with the present second embodiment to decide whether or not the speech signal is voiced by relying upon the tendency for the energy distribution of the voiced sound and that of the unvoiced sound or noise to be concentrated towards the lower and higher frequency range respectively.

Figure 5:
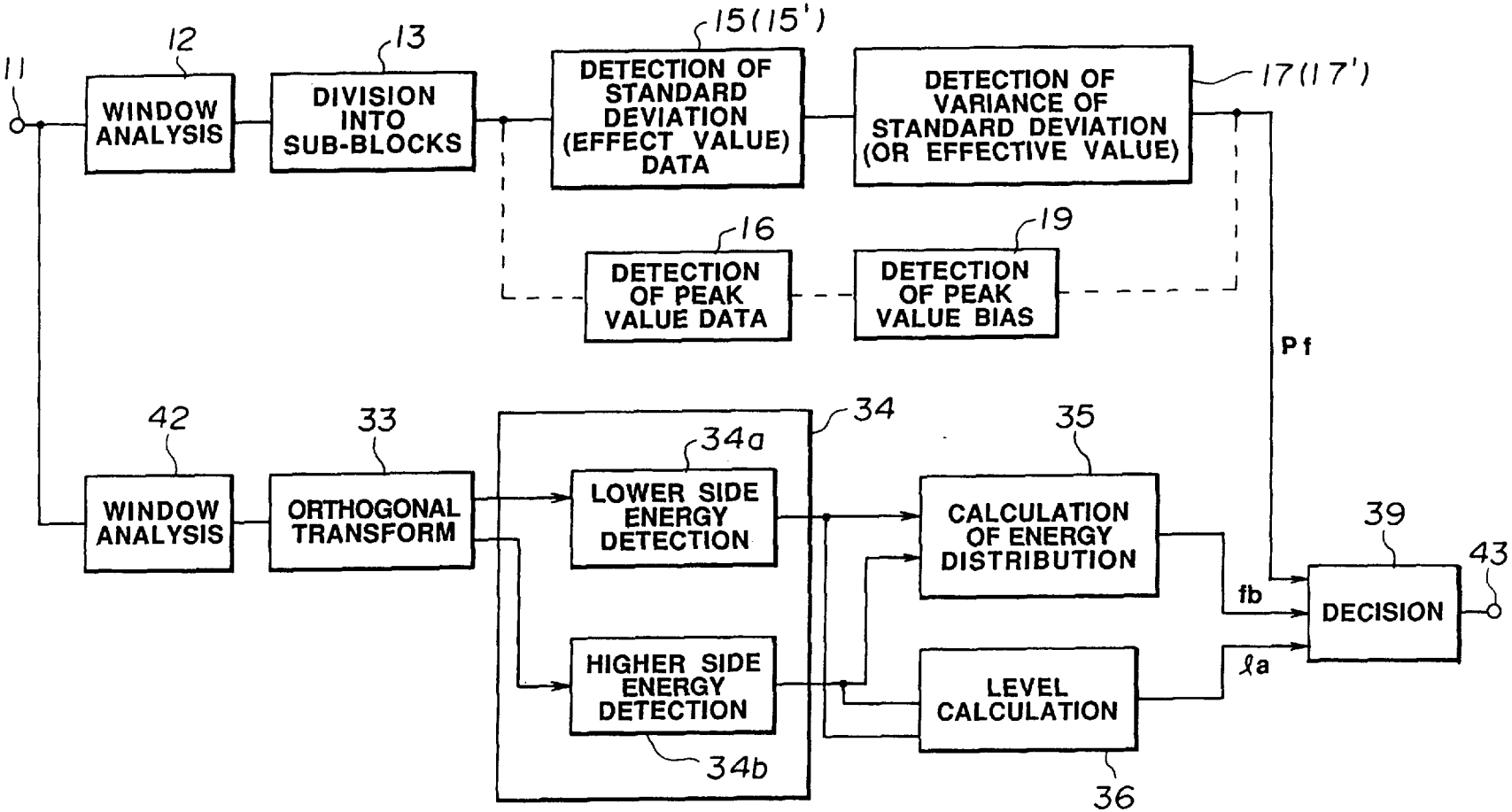
FIG. 5 is a functional block diagram showing a schematic arrangement of a voiced sound discriminating device for illustrating a third embodiment of the voiced sound discriminating device according to the present invention.

FIG. 5 schematically shows a voiced/unvoiced discriminating unit for illustrating a voiced sound discriminating method according to a third embodiment of the present invention.

Referring to FIG. 5, speech signals supplied to input terminal 11 via window analysis unit 12 and sub-block division unit 13 are freed at least of low-range components of less than 200 Hz, windowed by a rectangular window with N samples per block, N being e.g. 256, time-shifted and divided into sub-blocks, are supplied to a detection unit for detecting statistical characteristics. Statistic characteristics are detected of the, sub-block signals by the detection unit for detecting the statistic characteristics. In the present embodiment, the standard deviation data detecting unit 15, the effective value data detecting unit 15' or the peak value data detection unit 16 is used as such detection unit. The standard deviation or effective value bias detection unit 17 or the peak value bias detection unit 19, explained in the preceding first embodiment, detect the localization of the statistic characteristics on the time scale based on the above-mentioned statistical characteristics. The bias data from the localization detection unit 17 or 19 is supplied to decision unit 39. The energy detection unit 34 is supplied with data freed at least of low-range components of not more than 200 Hz by a window analysis unit 42 and an orthogonal transform unit 33, windowed by a hamming window with N samples per block, N being e.g. 256, time-shifted and orthogonal transformed into data on the frequency scale. The frequency-domain data are supplied to energy detection unit 34. The detected high-range side energy values and the detected low-range side energy values are supplied to an energy distribution calculation unit 35. The energy distribution data, as found by the energy distribution calculation unit 35, is supplied to a decision unit 39. The detected high-range side energy values and the detected low-range side energy values are also supplied to a signal level calculating unit 35 where a signal level per sample is calculated. The signal level data, calculated by the signal level calculating unit 36, is supplied to decision unit 39, which is also supplied with the above-mentioned bias data, energy distribution data and the signal level data. Based on these data, the decision unit 39 decides whether or not the input speech signal is voiced. The corresponding decision data is outputted at output terminal 43.

The operation of the present third embodiment is hereinafter explained.

With the present third embodiment, the decision unit 39 gives a voiced/unvoiced decision, using the bias data $p_f$ of the sub-frame signals from bias detection units 17, 17' or 19, energy distribution data $f_b$ from the distribution calculating unit 35 and the mean level data $l^a$ from the signal level calculating unit 36. For example, if $p_f<p_{thf}$, and $f_b<f_{thb}$ and $l^a<l_{tha}$, the input speech signal is decided to be not voiced with higher reliability.

In the present third embodiment, a decision as to whether or not the input speech signal is voiced is given responsive to the bias data of the statistical characteristics on the time scale, energy distribution data and mean value data.

If, in the voiced sound discriminating method according to the above-described embodiments, a voiced/unvoiced decision is to be given using the bias data $p_f$ of sub-frame signals, temporal changes of the data $p_f$ are pursued and the sub-block signals are decided to be flat only if $p_f<P_{thf}$ ($P_{thf}$=1.1)

for five frames on end, so that a flag $P_{fs}$ is set. If $p_f<P_{thf}$ for one or more of the five frames, the flag $P_{fs}$ is set to 0. If $f_b<f_{bt}$ and $P_{fs}$=1 and $l^a<l_{tha}$, the input speech signal may be decided to be not voiced with extremely high reliability.

If a decision is given that the signal is not voiced, that is, it is the background noise or the consonant, the entire block of the input speech signal is compulsorily set to be unvoiced sound to eliminate generation of an extraneous sound during voice synthesis using a vocoder such as MBE.

Figure 6:
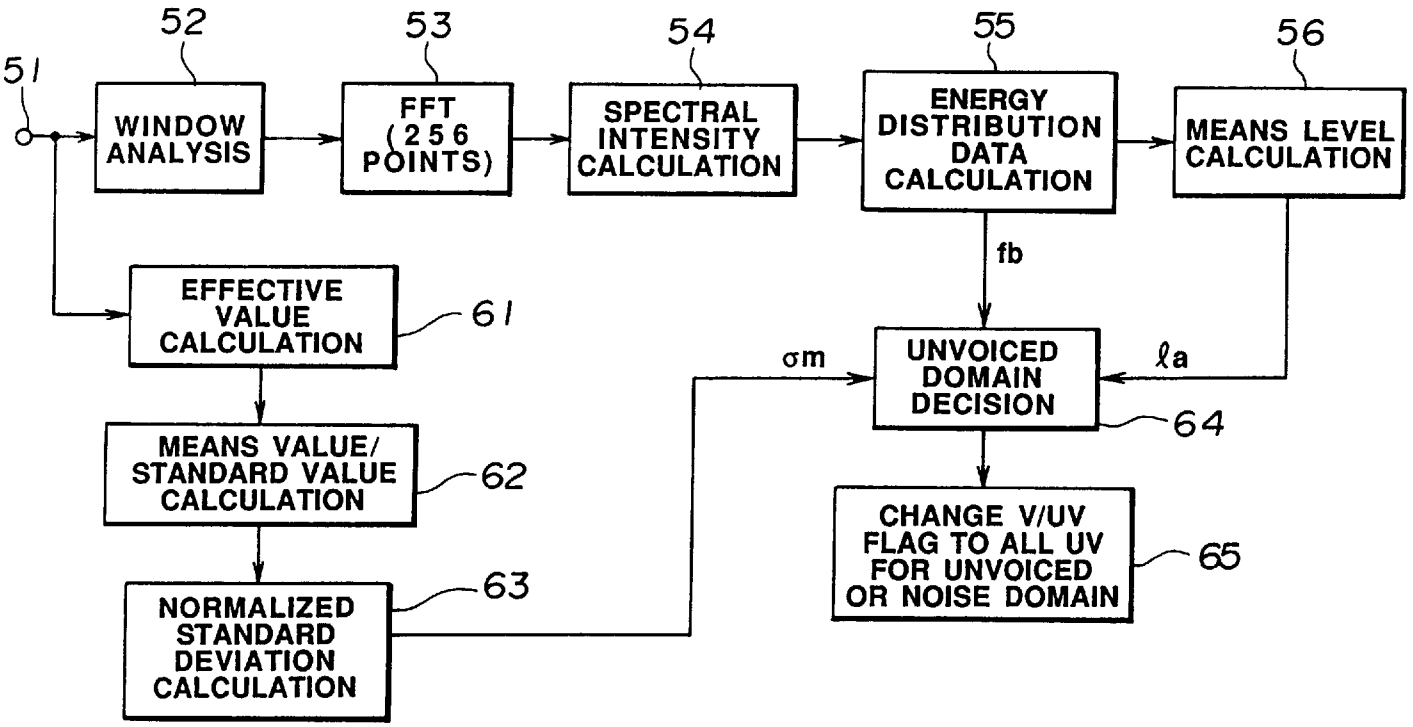
FIG. 6 is a functional block diagram showing a schematic arrangement of a voiced sound discriminating device for illustrating a fourth embodiment of the voiced sound discriminating device according to the present invention.
Figure 7A:
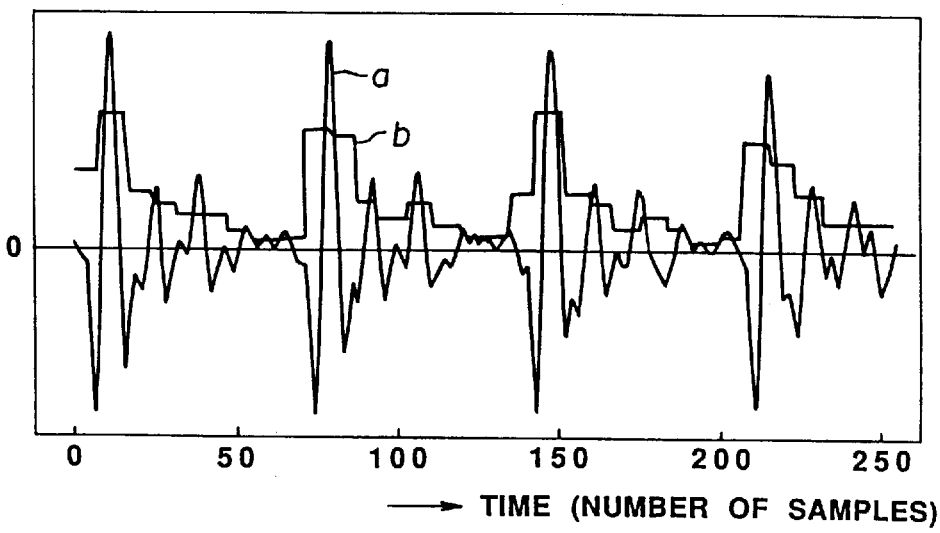
FIGS. 7*a* and 7*b* are waveform diagrams for illustrating distribution of short-time rms values as statistic characteristics of signals.
Figure 7B:
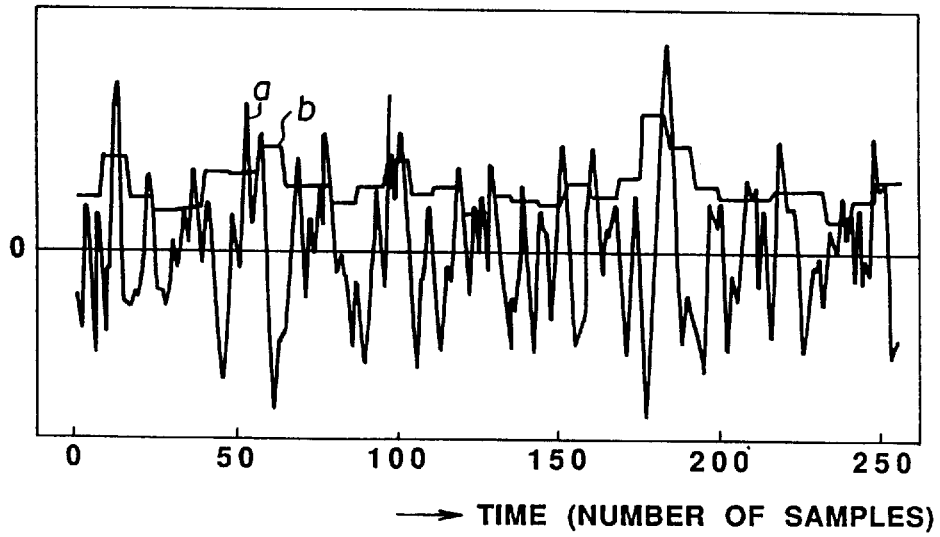

Referring to FIGS. 6, 7*a* and 7*b*, a fourth embodiment of the voiced sound discriminating method according to the present invention is explained.

In the above-described first embodiment, the ratio of the arithmetical mean to the geometrical mean of standard deviation data and effective value data is found to check for the distribution of standard deviation values and effective values (rms values) of the sub-block signals. For finding the geometrical mean value, it is necessary to carry out a number of times of data multiplication equal to the number of sub-blocks in each block, e.g. 32, and a processing of a 32 nd root for each of the sub-block signals. If 32 data are multiplied first, an overflow is necessarily produced, so that it becomes necessary to carry out a processing to find a 32 nd root of each sub-block signal prior to multiplication. In such case, 32 times of processing to find 32 nd roots are required to increase the processing volume.

Thus, in the present fourth embodiment, the standard deviation $\sigma_{rms}$ and a mean value $\underline{rms}$ of the effective values (rms values) of the 32 sub-blocks of each block are found and the distribution of the effective values (rms values) is detected depending on these values, for example, on the ratio of these values. That is, the effective rms value of each sub-block, the standard deviation $\sigma_{rms}$ and the mean value $\underline{rms}$ thereof in one block of the 32 sub-blocks, are expressed by the formulas (14), (15) and (16):

$$rms(i)=\sqrt{\frac{1}{B_L}\sum_{j=0}^{B_L-1}X^2(i\cdot B_L+j)} \tag{14}$$

where i is over or equal than 0, and less than $B_N$.(=32).

$$rms=\frac{1}{B_L}\sum_{i=0}^{B_N-1}rms(i) \tag{15}$$

where BN=32.

$$\sigma_{rms}=\sqrt{\frac{1}{B_N}\sum_{i=0}^{B_N-1}(rms(i)-\underline{rms})^2} \tag{16}$$

wherein i is an index for the sub-block, such as i=0 to 31, $B_L$ is the number of samples in each sub-block or sub-block length, such as $B_L$=8, and $B_N$ is the number of sub-blocks in each block, such as $B_N$=32. The number of samples N in each block is set to e.g. 256.

Since the standard deviation $\sigma_{rms}$ according to formula (16) is increased with increase in the signal level, it is normalized by division with the mean value $\underline{rms}$ of the formula (15), If the normalized standard deviation is expressed as $\sigma_{rms}$, $$\sigma_m=\sigma_{rms}/\text{rms} \tag{17}$$

where $\sigma_{rms}$ becomes larger and smaller for a voiced speech segment and an unvoiced speech segment or the background noise, respectively. Since the speech signal may be deemed to be voiced if $\sigma_m$ is larger than a predetermined threshold value $\sigma_{th}$, while it may be highly likely to be unvoiced or background noise if $\sigma_m$ is smaller than the threshold value $\sigma_{th}$, the remaining conditions, such as the signal level or the tilt of the spectrum, are analyzed. The concrete value of the threshold value $\sigma_{the}$ may be set to 0.4 ($\sigma_{the}$=0.4).

The reason the above-described analysis of the energy distribution on the time scale has been undertaken is that a difference in the manner of distribution of the short-time effective values (rms values) between the vowel part of the speech shown in FIG. 7*a* and the consonant part thereof shown in FIG. 7*b* is noticed from one sub-block to another. That is, the distribution of the short-time effective values (rms values) in the vowel part as shown by a curve b in FIG. 7*a* exhibits a larger bias, while that in the consonant part as shown by a curve b in FIG. 7*b* is substantially planar. Meanwhile, curves a in FIG. 7*a* and 7*b* represent signal waveforms or sample values. For analyzing the distribution of the short-time rms values, the ratio of the standard deviation in each block of the short-time rms values to the mean value $\underline{rms}$ thereof, that is the above-mentioned normalized standard deviation $\sigma_m$, is employed in the present embodiment.

An arrangement for the above-mentioned analysis of the energy distribution on the time scale is shown in FIG. 6. Input data from input terminal 51 are supplied to an effective value calculating unit 61 to find an effective value rms(i) from one sub-block to another. This effective value rms(i) is supplied to a mean value and standard deviation calculating unit 62 to find the mean value $\underline{rms}$ and the standard deviation $\sigma_{rms}$. These values are then supplied to a normalized standard deviation value calculating unit 63 to find the normalized standard deviation $\sigma_m$ which is supplied to a noise or unvoiced segment discriminating unit 64.

The manner of checking of the spectral gradient or tilt is hereinafter explained.

Usually, signal energies are concentrated in the low frequency range and in the high frequency range on the frequency scale with the voiced speech segment and with the unvoiced speech segment or background noise, respectively. Consequently, the ratio of the high and low range energies is taken and used as a measure for evaluation of whether or not the segment is a noise segment. That is, an input sample train x(n) in one block, supplied from input terminal 51 of FIG. 7, where $0\leqq n<N$ and N=256), is windowed by a window analysis unit 52, e.g. with a Hamming window, and processed with FFT by fast Fourier transform unit 53. The result of the above-described processing are indicated by Re(j) ($0 \leqq j < N/2$)

Im(j) ($0 \leqq j < N/2$)

where Re(j) and Im(j) are real number part and imaginary number part of the FFT coefficients, respectively. N/2 is equivalent to $\pi$ of the normalized frequency and corresponds to the real frequency of 4 kHz because x(n) is data resulting from sampling at a sampling frequency of 8 kHz.

The results of the FFT processing are supplied to a spectral intensity calculating unit 54 where the spectral intensity of each point on the frequency scale $a_m(j)$ is found.

The spectral intensity calculating unit 54 executes a processing similar to that executed by the energy detection unit 34 of the second embodiment, that is, it executes a processing according to formula (9). The spectrum intensities $a_m(j)$, that is the processing results, are supplied to energy distribution calculating unit 55. The unit 55 executes processing by energy detection units 34*a*, 34*b* of the low-range and high-range sides within the energy detection unit 34, that is processing of the low-range energies $S_L$ according to formula (10) and high-range energies $S_H$ according to formula (11), as shown in FIG. 4. The unit 55 also finds a ratio-parameter $f_b=S_L/S_H$, indicating an energy balance, according to formula (12). If the ratio is low, energy distribution is towards the high range side, so that the signal is likely to be a noise or a consonant sound. The parameter $f_b$ is supplied to an unvoiced segment discriminating unit 64 or discriminating the noise or unvoiced segment.

The mean signal level $l_a$, indicated by formula (13), is calculated by a mean level calculating unit 56, which is equivalent to the signal level calculating unit 36 of the preceding second embodiment. The mean signal level $l_a$ is also supplied to the unvoiced speech segment discriminating unit 64.

The unvoiced segment discriminating unit 64 for discriminates the voiced segment from the unvoiced speech segment or noise based on the calculated values $\sigma_m$, $f_b$ and $l_a$. If the processing for such discrimination is defined as F(*), the following may be recited as specific examples of the function $F(\sigma_m, f_b, l_a)$ By way of a first example, if the conditions $f_b<f_{bth}$ and $\sigma_m<\sigma_{mth}$ and $l_a<l_{ath}$ where $f_{bth}$, $\sigma_{mth}$ and $l_{ath}$ are threshold values, be satisfied, the speech signal is decided to be a noise and the band in its entirety is set to be unvoiced (UV). As specific examples for the threshold values, $f_{bth}$, $\sigma_{mth}$ and $l_{ath}$ may be equal to 15, 0.4 and 550, respectively.

By way of a second example, the normalized standard deviation $\sigma_m$. may be observed for a slightly longer time period for improving its reliability. Specifically, energy distribution on the time domain is deemed to be flat if $\sigma_m<\sigma_{mth}$ for an M number of consecutive blocks and a $\sigma_m$ state flag $\sigma_{state}$ is set ($\sigma_{state}=1$). If $\sigma_m \leqq_{mth}$ for any one or more of the locks, the $\sigma_m$ state flag $\sigma_{state}$ is reset ($\sigma_{state}=0$). As for the function F(*), the signal is decided to be noise or unvoiced if $f_b<f_{bth}$ and $\sigma_{state}=1$ and $l_a<l_{ath}$ with the V/UV flags being all set to UV.

If the normalized standard deviation $\sigma_m$ is improved in reliability, as in the second example, checking for the signal mean level $l_a$ may be dispensed with. As for the function F(*) in such case, the speech signal may be decided to be unvoiced or noise if $f_b<f_{bth}$ and $\sigma_{state}=1$.

With the above-described fourth embodiment, the background noise segment or the unvoiced segment can be detected accurately with a smaller processing volume. By compulsorily setting to UV a block decided to be background noise, it becomes possible to suppress extraneous sound, such as beat caused by noise encoding/decoding.

A concrete example of a multi-band excitation (MBE) vocoder, as a typical example of a speech signal synthesis/analysis apparatus (vocoder) to which the method of the present invention may be applied, is hereinafter explained. The MBE vocoder is disclosed in, for example, D. W. Griffin and J. S. Lim, Multi-band Excitation Vocoder, "IEEE Transactions Acoustics, Speech and Signal Processing, vol. 36, pp. 1223 to 1235, August 1988". With the conventional partial auto-correlation (PARCOR) vocoder, speech signals are modelled by switching between voiced and unvoiced segments on the block-by-block or frame-by-frame basis, whereas, with the MBE vocoder, speech signals are modeled on an assumption that a voiced segment and an unvoiced segment exist in a concurrent frequency domain, that is in the frequency domain of the same block or frame.

Figure 8:
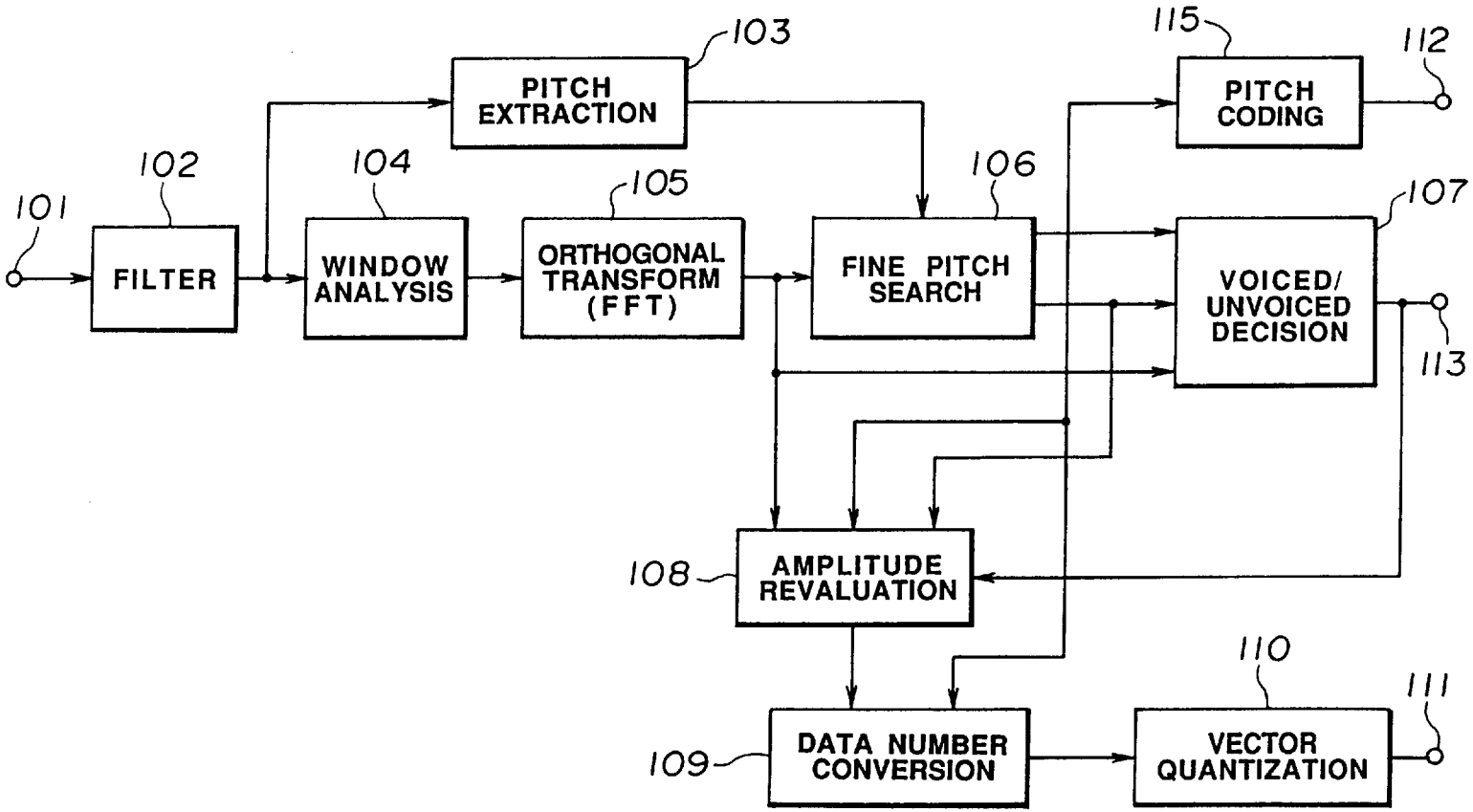
FIG. 8 is a functional block diagram showing a schematic arrangement of an analysis side (encoder side) of a speech signal synthesis/analysis system as a concrete example of a device to which the voiced sound discriminating method according to the present invention is applied.

FIG. 8 shows, in a schematic block diagram, the above-mentioned MBE vocoder in its entirety.

In this figure, input speech signals, supplied to an input terminal 101, are supplied to a high-pass filter (HPF) 102 where a dc offset and at least low-range components of 200 Hz or less for bandwidth limitation to e.g. 200 to 3,400 Hz, are eliminated. Output signals from filter 102 are supplied to a pitch extraction unit 103 and a window analysis unit 104. In the pitch extraction unit 103, the input speech signals are segmented by a rectangular window, that is, divided into blocks, each consisting of a predetermined number N of samples, N being e.g. 256, and pitch extraction is made for speech signals included in each block. The segmented block, consisting of 256 samples, are time shifted at a frame interval of L samples, L being e.g. 160, so that an overlap between adjacent blocks is N−L samples, e.g. 96 samples. The window analysis unit 104 multiplies the N-sample block with a predetermined window function, such as a hamming window, so that a windowed block is time shifted at an interval of L samples per frame.

Figure 9A:
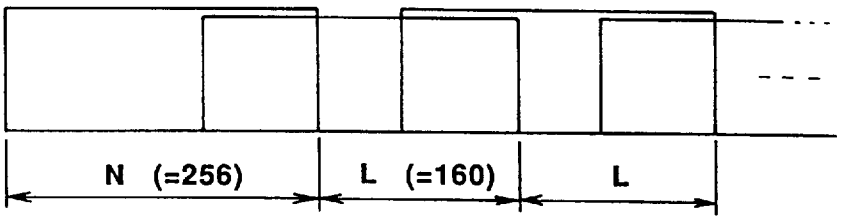
FIGS. 9*a* and 9*b* are graphs for illustrating a windowing operation.
Figure 9B:
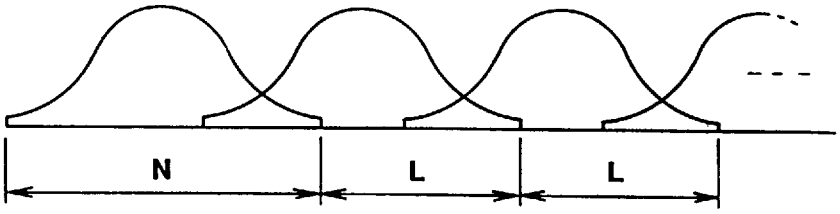

Such windowing operation may be mathematically represented by $$x_w(k,q)=x(q)w(kL-q) \tag{18}$$

wherein k indicates a block number and q the time index of data or sample number. Thus the above formula indicates that the q'th data x(q) of pre-processing input data is multiplied by a window function of the k'th block w(kL−q) to give data $x_w(k, q)$. The window function $w_r(r)$ within the pitch extraction unit 103 for a rectangular window shown in FIG. 9*a* is $$\begin{aligned} w_r(r) &= 1 \quad 0 \leqq r < N \\ &= 0 \quad r < 0, N \leqq r \end{aligned} \tag{19}$$

whereas the window function $w_h(r)$ in the window analysis unit 104 for the hamming window is $$\begin{aligned} w_h(r) &= 0.54 - 0.46 \quad \cos(2\pi r/(N-1) \\ &\qquad\qquad\qquad\quad 0 \leqq r < N \\ &= 0 \qquad\qquad\quad r < 0, N \leqq r \end{aligned} \tag{20}$$

Figure 10:
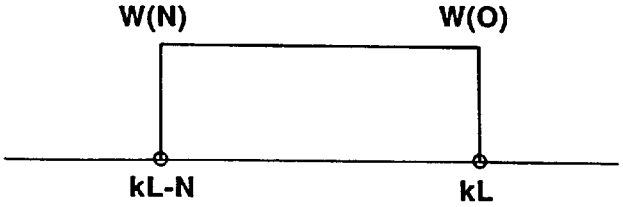
FIG. 10 is a graph for illustrating the relation between the windowing operation and a window function.

When employing the window functions $w_r(r)$ or $w_h(r)$, the non-zero segment of the window function w(r) (=w(kL−q)) is $0 \leqq kL-q < N$ Modifying this, $kL-N < q \leqq kL$ Therefore, it is when $kL-N<q\leqq kL$ that the window function $w_r(kL-q)$ is equal to 1 for the rectangular window, as shown in FIG. 10. Besides, the formulas (18) to (20) indicate that a window of a length N (=256) proceeds at a rate of L (=160) samples. The non-zero sample trains at each point N ($0\leqq r<N$), segmented by the window functions of the formulas (19), (20) are indicated as $x_{wr}(k, r)$ and $x_{wh}(k, r)$, respectively.

Figure 11:
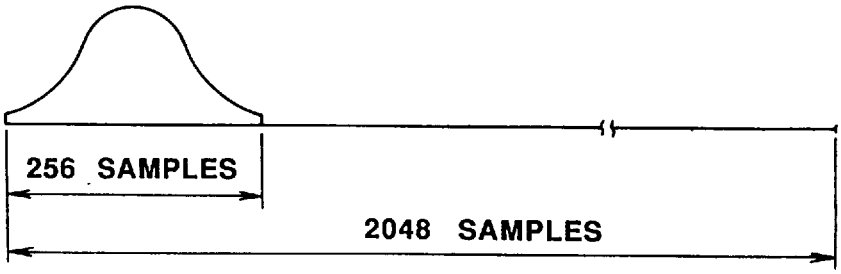
FIG. 11 is a graph showing time-domain data to be orthogonally transformed, herein FFT.

In the window analysis unit 104, 0-data for 1792 samples are appended to the 256-sample-per-block sample train $x_{wh}(k, r)$, multiplied by the Hamming window according to formula (20), to provide 2048 time-domain data string which is orthogonal transformed, e.g. fast Fourier transformed, by an orthogonal transform unit 105, as shown in FIG. 11.

In the pitch extraction unit 103, pitch extraction is performed on the N-sample-per-block sample train $x_{wr}(k, r)$. Pitch extraction may be achieved by taking advantage of periodicity of the time waveform or the frequency of the spectrum or an auto-correlation function. In the present embodiment, pitch extraction is achieved by a center clip waveform auto-correlation method. Although a clip level may be set for each block as the center clip level in each block, signal peak levels of the sub-blocks, divided from each block, are detected, and the clip levels are changed stepwise or continuously within the block in case of a larger difference in the peak levels of these sub-blocks. The pitch period is determined based on the peak position of the auto-correlation data of the center clip waveform. To this end, plural peak values are previously found from the auto-correlation data belonging to the current frame, wherein auto-correlation is found for the N-sample-per-block data. If the maximum one of the plural peaks exceeds a predetermined threshold, the maximum peak position is the pitch period. If otherwise, a peak is found which is within a pitch range satisfying a predetermined relation with respect to a pitch as found with frames other than the current frame, such as temporally preceding and succeeding frames, such as within a pitch range of ±20% with the pitch of the temporally preceding frame as center, and the pitch of the current frame is determined based on the thus found peak position. The pitch extraction unit 103 executes a rough pitch search by an open loop operation. Pitch data extracted by the unit 103 is supplied to a fine pitch search unit 106 where a fine pitch search by a closed loop operation is executed.

The rough pitch data from pitch extraction unit 103, expressed in integers, and frequency-domain data from orthogonal transform unit 105, such as fast Fourier transformed data, are supplied to fine pitch search unit 106. The fine pitch search unit 106 swings the data at an interval of 0.2 to 0.5 by ± several samples, about the rough pitch data value as the center, for arriving at an optimum fine pitch data as a floating-point number. As the fine search technique, a so-called analysis by synthesis method is employed, and the pitch is selected so that the synthesized power spectrum is closest to the power spectrum of the original sound.

Figure 14A:
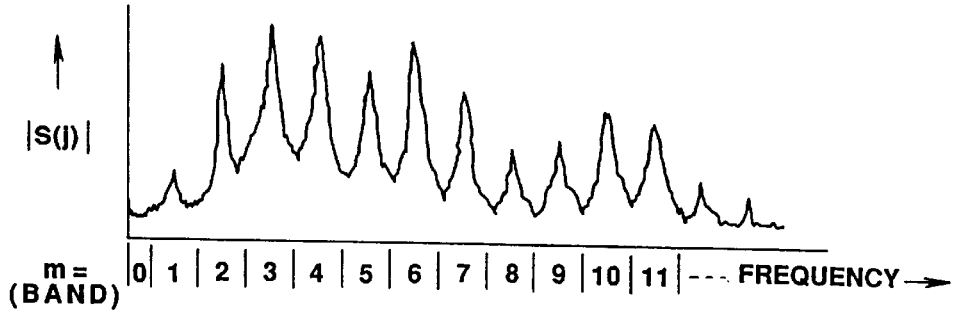
FIGS. 14*a* to 14*c* are graphs for illustrating synthesis of unvoiced sound during synthesis of speech signals.
Figure 14B:
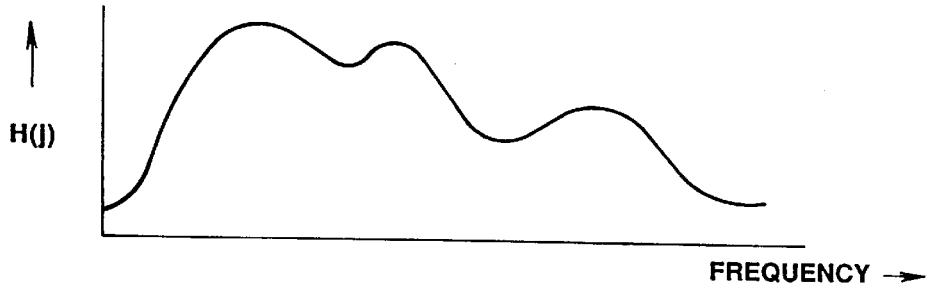
Figure 14C:
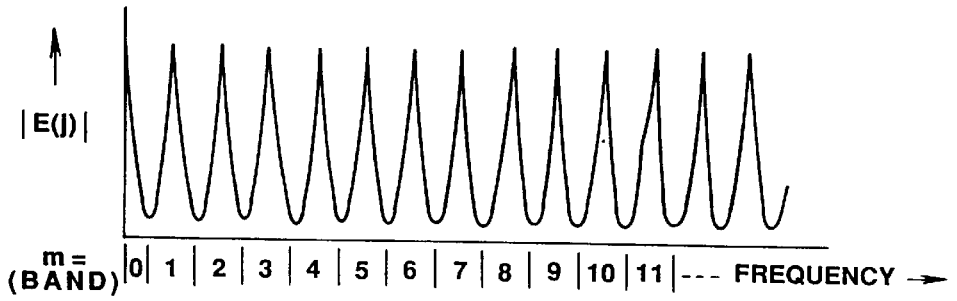

The fine pitch search is explained. First, with the above-mentioned MBE vocoder, the spectral data on the frequency domain S(j), obtained by orthogonal transform, such as FFT, is supposed to be modelled by the formula $$S(j)=H(j)|E(j)|0<j<J \tag{21}$$

where J corresponds to $\omega_s/4\pi=f_s/2$ and to 4 kHz if the sampling frequency $f_s=\omega_s/2\pi$ is 8 kHz. If, in the above formula (21), the spectral data S(j) on the frequency scale has a waveform as shown in FIG. 14*a*, H(j) represents an envelope of the original spectral data S(j), as shown in FIG. 14*b*, while E(j) represents the spectrum of periodic equi-level excitation signals as shown in FIG. 14*c*. In other words, the FFT spectrum S(j) is modelled as a product of the spectral envelope H(j) and the power spectrum of the excitation signals |E(j)|.

The power spectrum |E(j)| of the excitation signals is formed by repetitively arraying the spectral waveform, corresponding to the waveform of a frequency band, from band to band on the frequency scale, taking into account the periodicity of the waveform on the frequency scale as determined depending on the pitch. Such 1-band waveform may be formed by fast Fourier transforming the waveform shown in FIG. 11, which is the 256-sample hamming window function and 0 data for 1792 samples, appended thereto, and which herein is deemed to be time-domain signals, and by segmenting the resulting impulse waveform having a bandwidth on the frequency domain in accordance with the above pitch.

Then, for each of the bands, divided in accordance with the pitch, an amplitude $|A_m|$, which represents H(j) and minimizes the error from band to band, is found. If an upper limit and a lower limit of e.g. the m'th band, that is the band of the m'th harmonic, are denoted as $a_m$, $b_m$, respectively, an error $\epsilon_m$ of the m'th band is given by $$\epsilon_m = \sum_{j=a_m}^{b_x} \{|S(j)| - |A_m||E(j)|\}^2 \tag{22}$$

Such value of $|A_m|$ as will minimize the error $\epsilon_m$ is found from $$\frac{\partial \epsilon_m}{\partial |A_m|} = -2 \sum_{j=a_m}^{b_m} \{|S(j)||A_m||E(j)|\}|E(j)| = 0 \tag{23}$$

$$\therefore |A_m| = \sum_{j=a_m}^{b_m} |S(j)||E(j)| / \sum_{j=a_m}^{b_m} |E(j)|^2$$

The error $\epsilon_m$ is minimized when the value of $|A_m|$ is such as defined by the formula (23). Such amplitude $|A_m|$ is found from band to band and the error $\epsilon_m$ for each band, as defined by the formula (22), is found using each amplitude $|A_m|$ having the above value. The sum of the errors $\epsilon_m$ for all of the bands is then found. The sum $\Sigma\epsilon_m$ is found for several minutely different pitch values to find a pitch value which will minimize the error sum $\Sigma\epsilon_m$.

Specifically, several pitch values above and below each of an integer-valued rough pitch as found by the pith extraction unit 103 are provided at a graduation of e.g. 0.25. The error sum $\Sigma\epsilon_m$ is found for each of the plural pitch values. It is noted that, if the pitch is fixed, the band width is also fixed, so that the error $\epsilon_m$ of formula (22) may be found using the power spectrum |S(j)| and the excitation signal spectrum |E(j)| on the frequency scale, in accordance with formula (23), and hence the sum $\Sigma\epsilon_m$ for the totality of the bands may be found. The sum $\Sigma\epsilon_m$ is found for each of the plural pitch values to find an optimum pitch value associated with the minimum sum value. In this manner, an optimum fine pitch having a graduation of 0.25 and the amplitude $|A_m|$ associated with the optimum pitch may be found at the fine pitch search unit 106.

In the above explanation of the fine pitch search, the totality of the bands is assumed to be voiced, for simplifying the explanation. However, since the model employed in the M.BE vocoder is such that unvoiced segments are present on the concurrent frequency scale, it becomes necessary to make voiced/unvoiced decision for each of the frequency bands.

The optimum pitch data and the amplitude data $|A_m|$ from the fine pitch search unit 106 are transmitted to a voiced/unvoiced discriminating unit 107 where the voiced/unvoiced decision is performed from one band to another. For such discrimination, a noise to signal ratio (NSR) is used. That is the NSR of the m'th band is expressed by $$NSR = \frac{\sum_{j=a_m}^{b_m} \{|S(j)||A_m||E(j)|\}^2}{\sum_{j=a_m}^{b_m} |S(J)|^2} \tag{24}$$

If the NSR value is larger than a predetermined threshold, such as 0.3, that is if an error is larger, for a given band, it may be assumed that approximation of $|S(j)|$ by $|A_m||E(j)|$ for the band is not good, that is that the excitation signal $|E(j)|$ is inappropriate as the fundamental, signal, so that the band is decided to be unvoiced (UV). If otherwise, it may be assumed that approximation is good to a certain extent, so that the band is decided to be voiced (V).

An amplitude re-evaluation unit 108 is supplied with frequency-domain data from orthogonal transform unit 105, amplitude data $|A_m|$ from fine pitch search unit 106, evaluated as corresponding to fine pitch, and voiced/unvoiced (V/UV) discrimination data from V/UV discrimination unit 107. The amplitude re-evaluation unit 108 again finds the amplitude of the band decided to be unvoiced (UV) by the V/UV discriminating unit 107. The amplitude $|A_m|_{UV}$ of the UV band may be found by the formula $$|A_m|_{UV} = \sqrt{\sum_{j=a_m}^{b_m} |S(j)|^2/(b_m - a_m + 1)} \tag{25}$$

The data from the amplitude reevaluation unit 108 are transmitted to a data number conversion unit 109, which performs an operation similar to a sampling rate conversion. The data number conversion unit 109 assures a constant number of data, especially the number of amplitude data, in consideration of the variable number of frequency bands on the frequency scale, above all, the number of amplitude data. That is, if the effective range is up to 3400 Hz, the effective range is divided into 8 to 63 bands, depending on the pitch, so that the number $m_{MX}+1$ of amplitude data $|A_m|$, inclusive of the amplitude $|A_m|_{UV}$ of the UV bands, obtained from one band to another, is also changed in a grange of from 8 to 63. To this end, the data number conversion unit 109 converts the number of the variable amplitude data $m_{MX}+1$ into a constant number $N_c$, such as 44.

In the present embodiment, dummy data are appended to amplitude data for an effective one block on the frequency scale which will interpolate from the last data up to the first data in the block to increase the number of data to $N_F$. A number of amplitude data which is $K_{OS}$ times $N_F$, such as 8 times $N_F$ are found by bandwidth limiting type oversampling. The $((m_{MX}+1)\times K_{OS})$ number of amplitude data are linearly interpolated to increase the number of data to a larger value $N_M$, such as 2048, which $N_M$ number of data are sub-sampled to give the above-mentioned predetermined number $N_C$ of, e.g. 44, samples.

The data from the data number conversion unit 109, that is the constant number $N_C$ of amplitude data, are supplied to. a vector quantization unit 110, where they are grouped into sets each consisting of a predetermined number of data for vector quantization. Quantized output data from vector quantization unit 110 are outputted at output terminal 111. Fine pitch data from fine pitch search unit 106 are encoded by a pitch encoding unit 115 so as to be outputted at output terminal 112. The V/UV discrimination data from unit 107 are outputted at output terminal 113. These data from output terminals 11 to 113 are transmitted as predetermined format transmission signals.

Meanwhile, these data are produced by processing data in each block consisting of N samples, herein 256 samples. Since the block is time shifted with the L-sample frame as a unit, transmitted data are produced on the frame-by-frame basis. That is, the pitch data, V/UV discrimination data and amplitude data are updated at the frame period.

Figure 13:
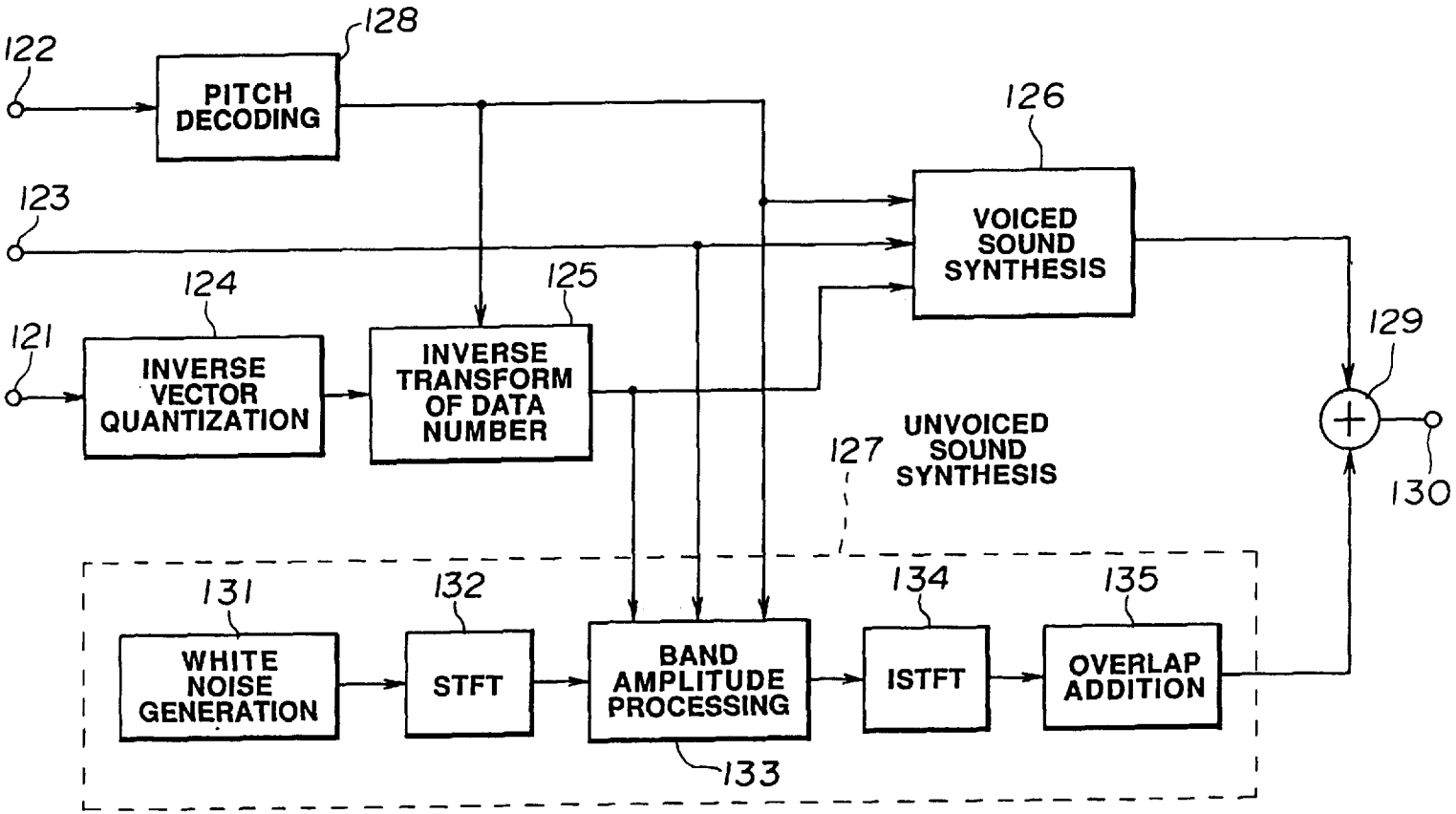
FIG. 13 is a functional block diagram showing a schematic arrangement of a synthesis side (decoder side) of a speech signal analysis/synthesis system as a concrete example, of a device to which the voiced sound discriminating method according to the present invention may be applied.

Referring to FIG. 13., an arrangement of the synthesis or decoder side for synthesizing the speech signals based on the transmitted data is explained.

Referring to FIG. 13, the vector quantized amplitude data, the encoded pitch data and the V/UV discrimination data are supplied to input terminals 121, 122 and 123, respectively. The vector quantized amplitude data are supplied to an inverse vector quantization unit 124 for inverse quantization and thence to data number inverse conversion unit 125 for inverse conversion. The resulting amplitude data are supplied to a voiced sound synthesis unit 126 and to an unvoiced sound synthesis unit 127. The encoded pitch data from input terminal 122 are decoded by a pitch decoding unit 128 and thence supplied to a data number inverse conversion unit 125, a voiced sound synthesis unit 126 and to an unvoiced sound synthesis unit 127. The V/UV discrimination data from input terminal 123 are supplied to voiced sound synthesis unit 126 and unvoiced sound synthesis unit 127.

The voiced sound synthesis unit 126 synthesizes a voiced sound waveform on the time scale by e.g. cosine waveform synthesis. The unvoiced sound synthesis unit 127 synthesizes unvoiced sound on the time domain by filtering a white noise by a band-pas filter. The synthesized voiced and unvoiced waveforms a r e summed or synthesized at an additive node 129 so as to be outputted at output terminal 130. The amplitude data, pitch data and V/UV discrimination data are updated during analysis at an interval of a frame consisting of L samples, such as 160 samples. However, for improving continuity or smoothness between adjacent frames, those amplitude or pitch data at e.g. the center of each frame are used as the above-mentioned amplitude or pitch data, and data values up to the next adjacent frame, that is the assynthesized frame, are found by interpolation. That is, in the synthesized frame, for example, an interval from the center of an analytic frame to the center of the next analytic frame, data values at a leading end sampling point and at a terminal end sampling point, that is at a leading end of the next synthetic frame, are given, and data values between these sampling points are found by interpolation.

The synthesizing operation by the voiced sound synthesis unit 126 is explained in detail.

If the voiced sound of the above-mentioned synthetic time-domain frame, consisting of L samples, for example, 160 samples, for the m'th band, that is the m'th harmonics, decided to be voiced (V), is denoted as $V_m(n)$, it my be expressed by $$V_M(n)=A_m(n)\cos(\theta_m(n)), 0 \leq n < L \tag{26}$$

using the time index or sample number in the synthetic frame. The voiced sounds of the bands decided to be voiced (V), among the totality of the bands, are summed together $(\Sigma V_m(n))$ to synthesize the ultimate voiced sound V(n).

In the formula (26), $A_m(n)$ is an amplitude of the m'th harmonics as interpolated between the leading end and the terminal end of the synthetic frame. Most simply, it suffices to linearly interpolate the values of the m'th harmonics updated from frame to frame. That is, if the amplitude value of the m'th harmonics at the leading end (n=0) of the assynthesized frame is denoted as $A_{0m}$ and the amplitude value of the m'th harmonics at the trailing end (n=L) of the synthetic frame, that is at the leading end of the next synthetic frame, is denoted as $A_{Lm}$, it suffices to calculate $A_m(n)$ by the formula $$A_m(n)=(L-n)A_{0m}/L+nA_{Lm}/L \tag{27}$$

The phase $\theta_m(n)$ in the above formula (26) may be found by the formula $$\theta_m(n)=m\omega_{01}n+n^2m(\omega_{L1}-\omega_{01})/2L+\phi_{0m}+\Delta\omega n \tag{28}$$

where $\phi_{0m}$ denotes the phase of the m'th harmonics at the leading end (n=0) of the synthetic frame (initial phase of the frame), $\omega_{01}$ denotes a fundamental angular frequency at the leading end of the synthetic frame (n=0) and $\omega_{L1}$ denotes a fundamental angular frequency at the trailing end (n=L) of the synthetic frame or at the leading end of the next synthetic frame. $\Delta\omega$ in the above formula (28) is selected to be minimum so that the phase $\phi_{Lm}$ at n=L became equal to $\theta_m(L)$.

The manner of finding the amplitude $A_m(n)$ and the phase $\theta_m(n)$ for an arbitrary m'th band, depending on the results of V/UV discrimination for n=0 and n=L, is hereinafter explained.

If the m'th band is decided to be voiced both for n=0 and n=L, the amplitude $A_m(n)$ may be found by linear interpolation of the transmitted values of the amplitudes $A_{0m}$, $A_{Lm}$ in accordance with formula (27). $\Delta\omega$ is set so that the phase $\theta_m(n)$ ranges from $\theta_m(0)$ equal to $\phi_{0m}$ for n=0 to $\theta_m(L)$ equal to $\phi_{Lm}$ for n=L.

If the m'th band is decided to be voiced and unvoiced for n=0 and n=L, respectively, the amplitude $A_m(n)$ is linearly interpolated so that the transmitted amplitude value ranges from $A_{0m}$ for $A_m(0)$ to 0 for $A_m(L)$. The transmitted amplitude value $A_{Lm}$ for n=L is an amplitude value of the unvoiced sound employed at the time of synthesis of the unvoiced sound as later explained. The phase $\theta_m(n)$ is set so that $\theta_m(0)=\phi_{0m}$ and $\Delta\omega=0$.

If the m'th band is decided to be unvoiced and voiced for n=0 and for n=L, respectively, the amplitude $A_m(n)$ is linearly interpolated so that so that the amplitude $A_m(0)$ for n=0 is 0 and the amplitude value becomes equal to the transmitted value $A_{Lm}$ for n=L. The phase $\theta_m(n)$ is set so that the phase $\theta_m(0)$ for n=0 is given by $$\theta_m(0)=\phi_{Lm}-m(\omega_{01}+\omega_{L1})L/2 \tag{29}$$

using the phase value $\phi_{Lm}$ at the terminal end of a frame, and $\Delta\omega$ is set so that $\Delta\omega=0$.

The technique of setting $\Delta\omega$ so that $\theta_m(L)$ is equal to $\phi_{Lm}$ when the m'th band is decided to be voiced both for n=0 and n=L is explained. By setting n=1 in formula (24), $$\begin{aligned}\Theta_m(L) &= m\omega_{01}L + L^2m(\omega_{L1}-\omega_{01})/2L + \phi^{0m} + \Delta\omega L\\ &= m(\omega_{01}+\omega_{L1})L/2 + \phi_{0m} + \Delta\omega L\\ &= \phi_{Lm}\end{aligned}$$

Arranging, $\Delta\omega$ becomes $$\Delta\omega=(\text{mod } 2\pi((\phi_{Lm}-\phi_{0m}) - mL(\omega_{0l}+\omega_{L1})/2)/L \tag{30}$$

In the above formula (30), mod $2\pi(x)$ is function which maps the main value of x by a value between $-\pi$ and $+\pi$. For example; if $x=1.3\pi$, $2.3\pi$ and $-1.3\pi$, mod $2\pi(x)$ is equal to $-0.7\pi$, $0.3\pi$ and $0.7\pi$, respectively.

FIG. 14*a* shows an example of the spectrum of the speech signals wherein the bands having the band numbers or harmonics numbers of 8, 9 and 10 are decided to be unvoiced, with the remaining bands being decided to be voiced. The time-domain signals of the voiced and unvoiced bands are synthesized by the voiced sound synthesis unit 126 and the unvoiced sound synthesis unit 127, respectively.

The operation of synthesizing the unvoiced sound by the unvoiced sound synthesis unit 127 is explained.

Figure 12A:
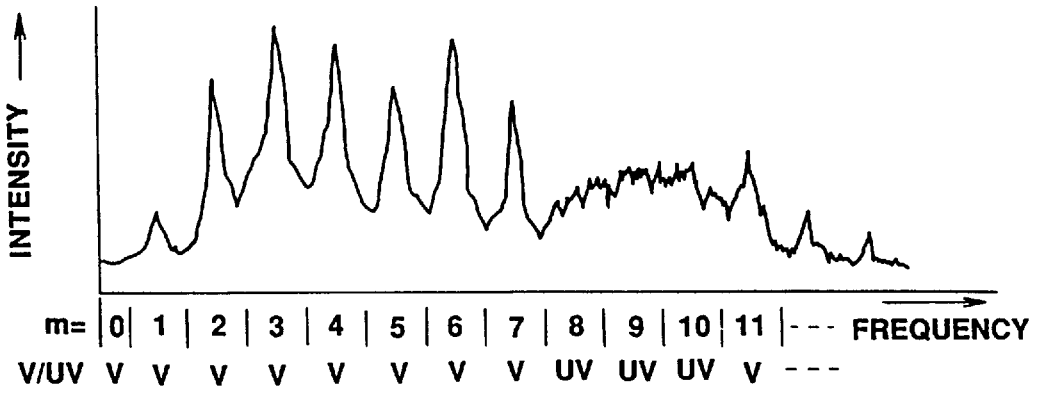
FIG. 12*a* is a graph showing the intensity of spectral data on the frequency domain.
Figure 12B:
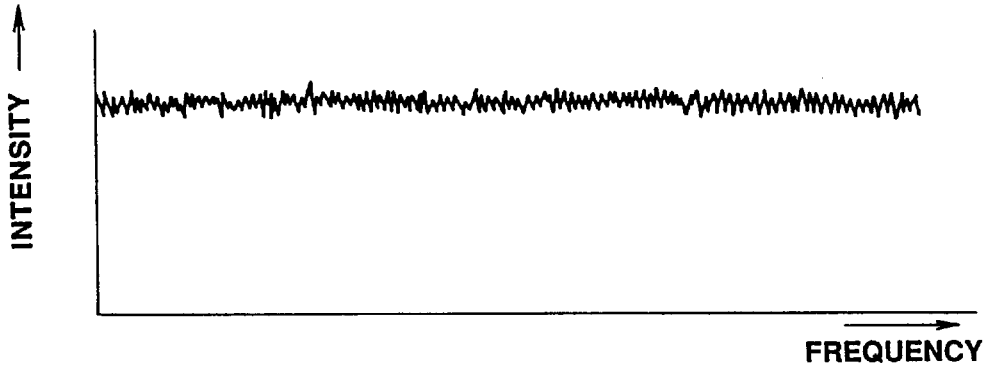
FIG. 12*b* is a graph showing the intensity of a spectral envelope on the frequency domain.
Figure 12C:
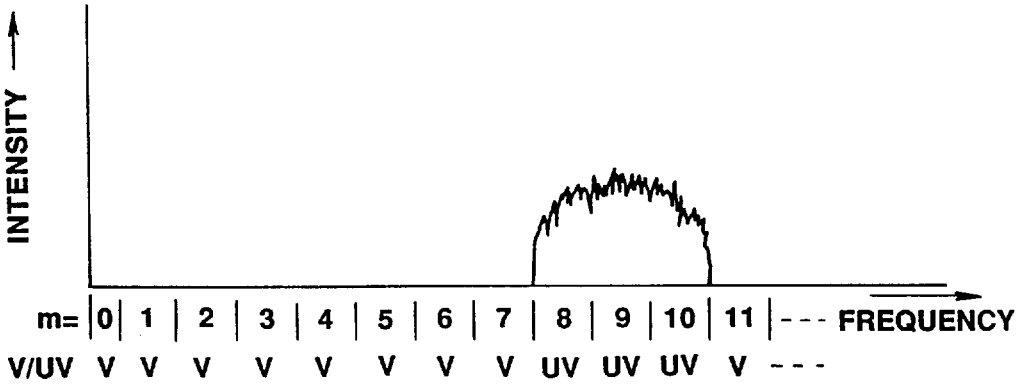
FIG. 12*c* is a graph showing the intensity of a power spectrum of excitation signals on the frequency domain.

The time-domain white noise signal waveform from white noise generator 131 is windowed by a suitable window function, such as a hamming window, to a predetermined number, such as 256 samples,and short-time Fourier transformed by an STFT unit 132 to produce a power spectrum of the white noise on the frequency scale, as shown in FIG. 12*b*. The power spectrum from unit 132 is supplied to a band amplitude processing unit 133 where the spectrum for the bands for m=8, 9, 10 decided to be unvoiced is multiplied by the amplitude $|A_m|_{UV}$ while the spectrum of the remaining bands are set to 0, as shown in FIG. 12*c*. The power amplitude processing unit 133 is supplied with the above-mentioned amplitude data, pitch data and V/UV discrimination data. An output of the band amplitude processing unit 133 is supplied to an ISTFT unit 134 where it is inverse short-time Fourier transformed using the phase of the original white noise for transforming the frequency-domain signal into the time-domain signal. An output of the ISTFT processing unit 134 is supplied to an weighted overlap-add unit 135 where it is processed with a repeated weighted overlap-add processing on the time scale to enable the original continuous noise waveform to be restored. In this manner, a continuous time-domain waveform is synthesized. An output signal from the overlap-add unit 135 is supplied to the additive node 129.

In this manner, signals of the voiced and unvoiced segments, synthesized by the synthesis units 126, 127 and re-transformed to the time-domain signals are mixed at the additive node 129 at a suitable fixed mixing ratio. The reproduced speech signals are outputted at output terminal 130.

The voiced/unvoiced discriminating method according to the present invention may also be employed as means for detecting the background noise for decreasing the environmental noise (background noise) at the transmitting side of e.g. a car telephone. That is, the present method may also be employed for noise detection for so-called speech enhancement of processing the low-quality speech signals mixed with noise for eliminating adverse effects by the noise to provide a sound closer to a pure sound.

What is claimed is:

1. A method for discriminating a digital speech sound comprising dividing digital speech signals into signal blocks each including a predetermined number of samples, and making a decision for each of said signal blocks as to whether the speech sound is voiced, said method further comprising the steps of:

transforming signals of each of said signal blocks into data on the frequency scale, finding low frequency range energies based on said data on the frequency scale, finding high frequency range energies based on said data on the frequency scale, finding a mean signal level of each of said signal blocks from low frequency range energies and high frequency range energies, dividing signals of each of said signal blocks into plural sub-blocks, analyzing said sub-blocks to find statistical characteristics of each of said sub-blocks, calculating a bias of said statistical characteristics of said signals in the time domain, and, deciding whether or not said signal blocks are voiced by comparing said mean signal level with a first predetermined threshold and by further comparing said bias of said statistical characteristics in the time domain with a second predetermined threshold.

2. The method as claimed in claim 1 wherein a decision as to whether or not said signal blocks are voiced is made further based on a ratio between said low frequency range energies and said high frequency range energies.

3. The method as claimed in claim 1 wherein a ratio between low frequency range energies and high frequency range energies are found based on said low frequency range energies and said high frequency range energies and wherein a decision as to whether or not said signal blocks are voiced is made by further comparing said ratio with a predetermined threshold.

4. The method as claimed in claim 1 wherein said low frequency range energies and said high frequency range energies are demarcated from each other at a demarcation frequency which is between 0 kHz and 3.4 kHz.

5. The method as claimed in claim 1 further comprising the step of:

finding between said low frequency range energies and said high frequency range energies, said ratio being used as basis in deciding whether or not said signal blocks are voiced.

6. The method as claimed in claim 1 further comprising the steps of:

finding a ratio between said low frequency range energies and said high frequency range energies, and, deciding whether or not each of said signal blocks are voiced by further comparing said ratio with a predetermined threshold.

7. A method for discriminating a digital speech sound comprising dividing digital speech signals into signal blocks each including a predetermined number of samples, and making a decision as to whether or not the speech sound is voiced for each of said signal blocks, said method further comprising the steps of:

finding an effective value of signals in each of a plurality of sub-blocks divided from each of said signal blocks, finding a standard deviation and a mean value of said signals of each signal block based on the effective value as found for each of said sub-blocks, finding a normalized standard deviation in the time domain based on said standard deviation and said mean value, frequency-analyzing signals of each of said signal blocks to find spectral intensities at a plurality of frequencies, finding an energy distribution based on said spectral intensity at each of said plurality of frequencies, finding a mean signal level of signals of each of said signal blocks from said energy distribution, and, making a decision as to whether or not said signal blocks are voiced by comparing said normalized standard deviation, said energy distribution and said mean signal level with each corresponding predetermined threshold.

8. The method as claimed in claim 7 wherein said spectral intensities at each point of the frequency domain are divided into groups of low-range frequency and high-range frequency and wherein said energy distribution is found based on a ratio between energies of the respective groups.

9. The method as claimed in claim 8 wherein said low frequency range energies and said high frequency range energies are demarcated from each other at a demarcation frequency which is between 0 kHz and 3.4 kHz.

10. An apparatus for discriminating a digital speech sound by dividing digital speech signals into signal blocks each including a predetermined number of samples, and making a decision for each of said signal blocks, as to whether or not the speech sound is voiced, said apparatus comprising:

frequency data calculating means for transforming signals of each of said signal blocks into frequency-domain data, means for finding low frequency range energies based on said frequency-domain data, means for finding high frequency range energies based on said frequency-domain data, means for finding a mean signal level of each of said signal blocks from said low frequency range energies and said high range energies, means for dividing signals of said signal block into plural sub-blocks, means for analyzing said sub-blocks for finding statistical characteristics of each of said sub-blocks, means for calculating a bias of said statistical characteristics of said signals in the time domain, and, decision means for making a decision as to whether or not said signal blocks are voiced by comparing said mean signal level with a first predetermined threshold and by further comparing said bias of said statistical characteristics in the time domain with a second predetermined threshold.

11. The apparatus as claimed in claim 10 wherein said decision means decides whether or not said signal blocks are voiced further based on a ratio between said low frequency range energies and said high frequency range energies.

12. The apparatus as claimed in claim 10 further comprising:

means for finding a ratio between said low frequency range energies and said high frequency range energies based on said low frequency range energies and said high frequency range energies wherein said decision means decides whether or not said signal blocks are voiced by further comparing said ratio with a predetermined threshold.

13. The apparatus as claimed in claim 10 wherein said low frequency range energies and said high frequency range energies are demarcated from each other at a demarcation frequency which is between 0 kHz and 3.4 kHz.

14. The apparatus as claimed in claim 10 further comprising:

means for finding a ratio between said low frequency range energies and said high frequency range energies, said ratio being used as basis in deciding whether or not said signal blocks are voiced.

15. The apparatus as claimed in claim 10 further comprising:

means for finding a ratio between said low frequency range energies and said high frequency range energies, wherein said decision means decides whether or not said signal blocks are voiced by further comparing said ratio with a predetermined threshold.

16. An apparatus for discriminating a digital speech sound by dividing digital speech signals into signal blocks each including a predetermined number of samples, and making a decision for each of said signal blocks as to whether or not the speech sound is voiced, said apparatus comprising:

means for finding an effective value of signals in each of a plurality of sub-blocks divided from each of said signal blocks, means for finding a standard deviation and a mean value of said signals of each signal block based on an effective value as found for each of said sub-blocks, means for finding a normalized standard deviation in the time domain based on said standard deviation and said mean value, means for frequency-analyzing signals of each of said signal blocks to find spectral intensities at a plurality of frequencies, means for finding energy distribution based on said spectral intensity at each of said plurality of frequencies, means for finding a mean signal level of signals of each of said signal blocks from said energy distribution, and, decision means for deciding whether or not said signal blocks are voiced by comparing said normalized standard deviation, said energy distribution and said mean signal level with each corresponding predetermined threshold.

17. The apparatus as claimed in claim 16 wherein said spectral intensities at each point of the frequency domain are divided into groups of low-range frequency and high-range frequency and wherein said energy distribution is found based on a ratio between energies of the respective groups.

* * * * *